US012070109B2

(12) United States Patent
Thompson

(10) Patent No.: US 12,070,109 B2
(45) Date of Patent: Aug. 27, 2024

(54) POCKET FOR ARTICLES OR ELECTRONIC DEVICE

(71) Applicant: James L Thompson, Greenacres, WA (US)

(72) Inventor: James L Thompson, Greenacres, WA (US)

( * ) Notice: Subject to any disclaimer, the term of this patent is extended or adjusted under 35 U.S.C. 154(b) by 886 days.

(21) Appl. No.: 16/859,803

(22) Filed: Apr. 27, 2020

(65) Prior Publication Data

US 2020/0288830 A1 Sep. 17, 2020

Related U.S. Application Data

(63) Continuation of application No. 15/669,904, filed on Aug. 5, 2017, now Pat. No. 10,631,606.

(60) Provisional application No. 62/371,393, filed on Aug. 5, 2016.

(51) Int. Cl.

| | |
|---|---|
| ***A41D 27/20*** | (2006.01) |
| ***A45C 1/04*** | (2006.01) |
| ***A45F 3/14*** | (2006.01) |
| *A41D 27/00* | (2006.01) |
| *A45F 5/00* | (2006.01) |

(52) U.S. Cl.

CPC ..... *A45C 1/04* (2013.01); *A41D 27/201* (2013.01); *A41D 27/208* (2013.01); *A45F 3/14* (2013.01); *A41D 27/00* (2013.01); *A45F 5/00* (2013.01); *A45F 2005/008* (2013.01)

(58) Field of Classification Search

CPC ..... A45C 1/04; A45F 5/00; A45F 3/14; A45D 27/205

See application file for complete search history.

(56) References Cited

U.S. PATENT DOCUMENTS

| | | | | |
|---|---|---|---|---|
| 2,561,872 | A * | 7/1951 | Krinick | A41D 13/065 2/24 |
| 2,568,083 | A * | 9/1951 | Mitchell | A41D 13/065 2/23 |
| 4,561,123 | A * | 12/1985 | Hull | A41D 13/0562 2/24 |
| 5,737,775 | A * | 4/1998 | Schwartz | A41D 27/20 2/243.1 |
| 5,884,338 | A | 3/1999 | Golde | |
| 5,946,732 | A | 9/1999 | Richards | |
| D542,792 | S | 5/2007 | Beamish et al. | |
| 7,725,951 | B2 * | 6/2010 | Rampersad | A41D 13/065 2/24 |
| D683,135 | S | 5/2013 | Smith | |
| 9,655,391 | B2 * | 5/2017 | Carver | A41D 13/065 |
| 10,004,285 | B2 * | 6/2018 | Johnson | A41D 13/0556 |

(Continued)

OTHER PUBLICATIONS

Lume Lifestyle, "End of promotion, full & cropped length, Smart Bundle", Website, 2016-0821 (downloaded date), Website: http://www.lumelifestyle.com/collections/lume-smart-leggings/products/end-of-promotion-smart-bundle?utm_source=Smart%20Bundle%20-%20FB%20Post&utm_medium=Smart%20Bundle%20-%20FB%20Post&utm_campaign=Smart%20Bundle%20-%20FB%20Post.

*Primary Examiner* — Tajash D Patel
(74) *Attorney, Agent, or Firm* — Kunzler Bean & Adamson

(57) ABSTRACT

A pocket, a garment, and a method of using the pocket on the garment. A first selective garment attachment interface is disposed at a first end of a pocket. A second selective garment attachment interface is disposed at a second end of a pocket distal from a first end of the pocket. First and second selective garment attachment interfaces are configured to selectively couple a pocket to a surface of a garment.

19 Claims, 16 Drawing Sheets

(56) References Cited

U.S. PATENT DOCUMENTS

| | | | | |
|---|---|---|---|---|
| 2003/0222109 | A1 | 12/2003 | Weiss | |
| 2007/0215663 | A1* | 9/2007 | Chongson | A45C 13/30 224/236 |
| 2011/0167536 | A1 | 7/2011 | Kellerhals | |
| 2011/0226831 | A1* | 9/2011 | Crifasi | A45C 1/04 224/681 |
| 2012/0185999 | A1 | 7/2012 | Raviv | |
| 2014/0312092 | A1 | 10/2014 | Waters | |
| 2015/0135405 | A1 | 5/2015 | Rothschild | |
| 2015/0195392 | A1 | 7/2015 | Nissenbaum | |
| 2015/0296909 | A1 | 10/2015 | Sachs | |
| 2018/0008022 | A1* | 1/2018 | Tien | A45C 3/00 |
| 2022/0175058 | A1* | 6/2022 | McIntyre | A41D 27/205 |
| 2022/0346477 | A1* | 11/2022 | Schottenstein | A41D 27/205 |

* cited by examiner

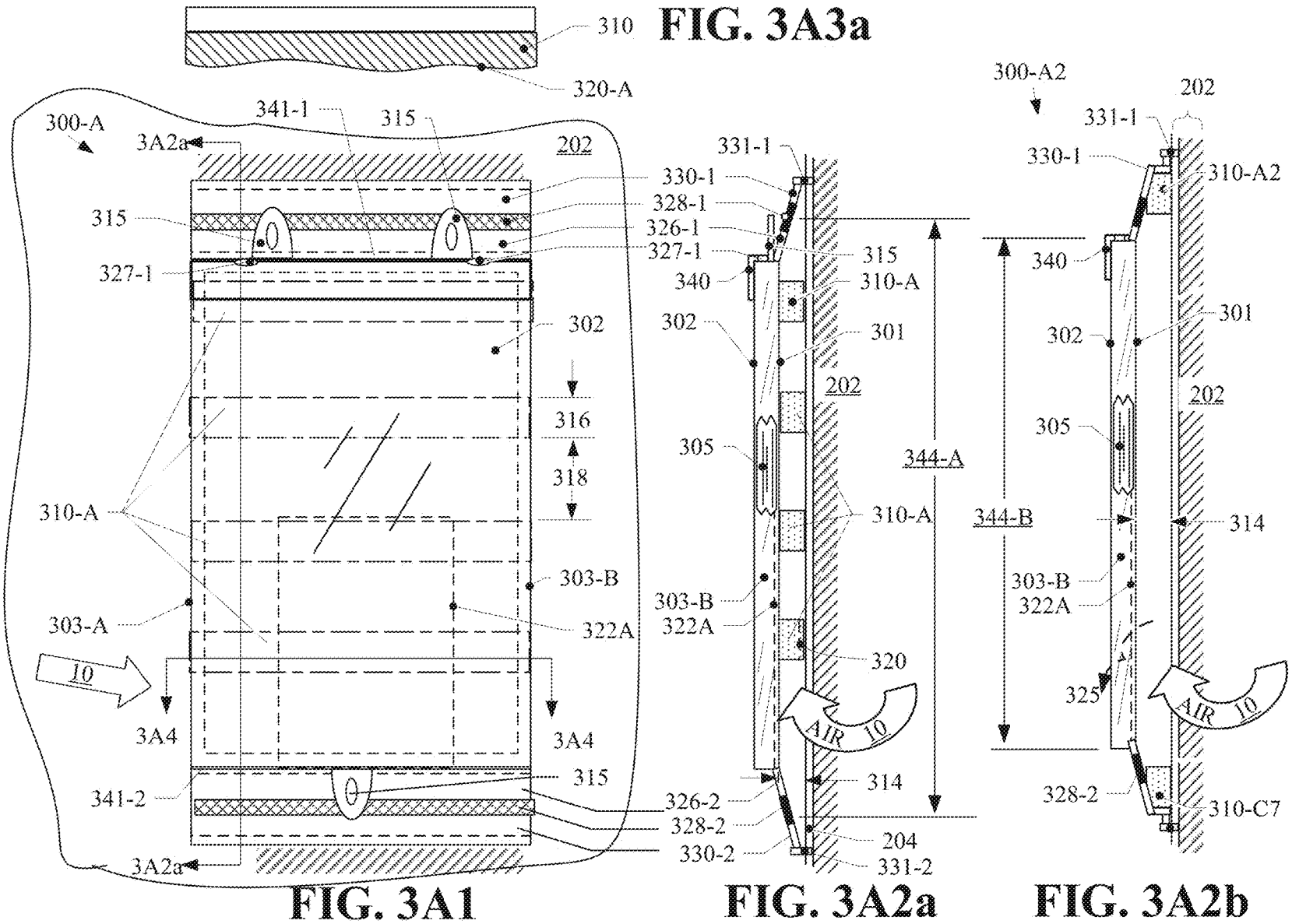
FIG. 3A3a
FIG. 3A2b
FIG. 3A2a
FIG. 3A1
AIR
10
300-A2
300-A
202
204
301
302
303-A
303-B
305
310
310-A
310-A2
310-C7
314
315
316
318
320
320-A
322A
325
326-1
326-2
327-1
328-1
328-2
330-1
330-2
331-1
331-2
340
341-1
341-2
344-A
344-B
3A2a
3A4

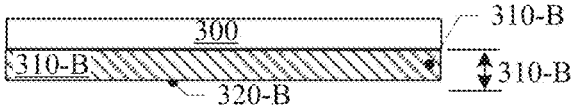
FIG. 3A3b
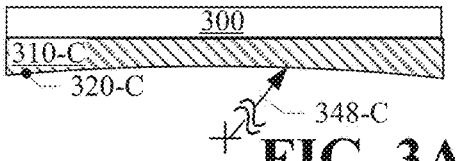
FIG. 3A3c
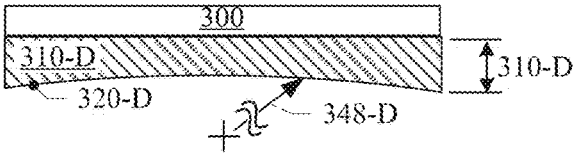
FIG. 3A3d
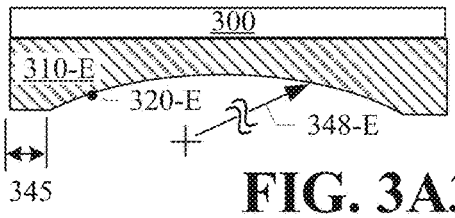
FIG. 3A3e
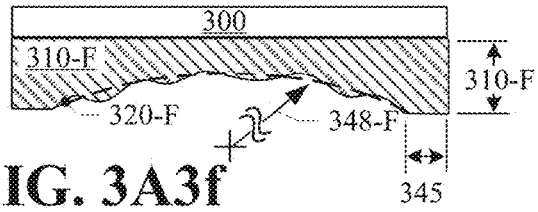
FIG. 3A3f
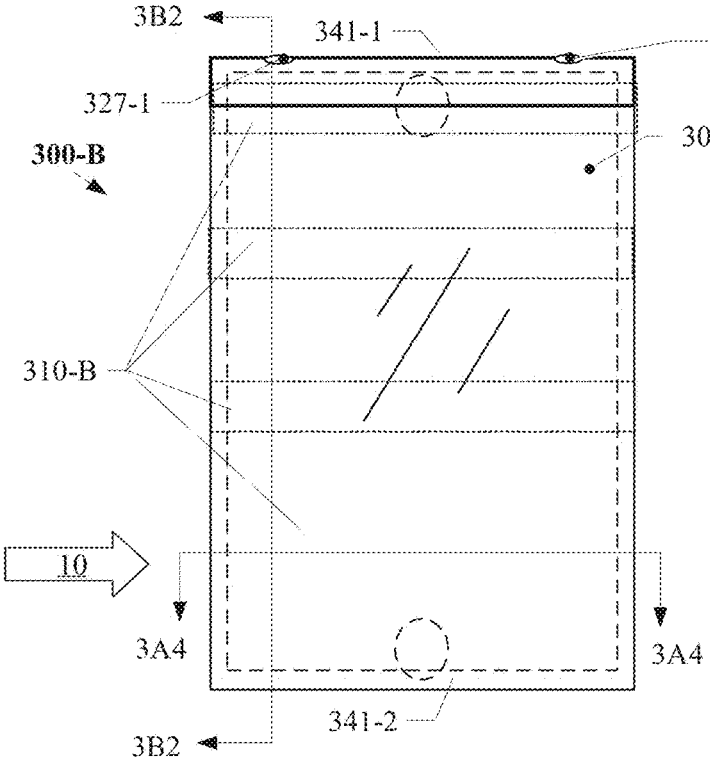
FIG. 3B1
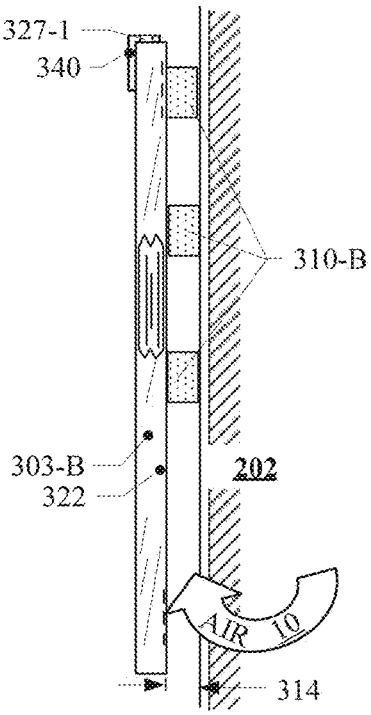
FIG. 3B2

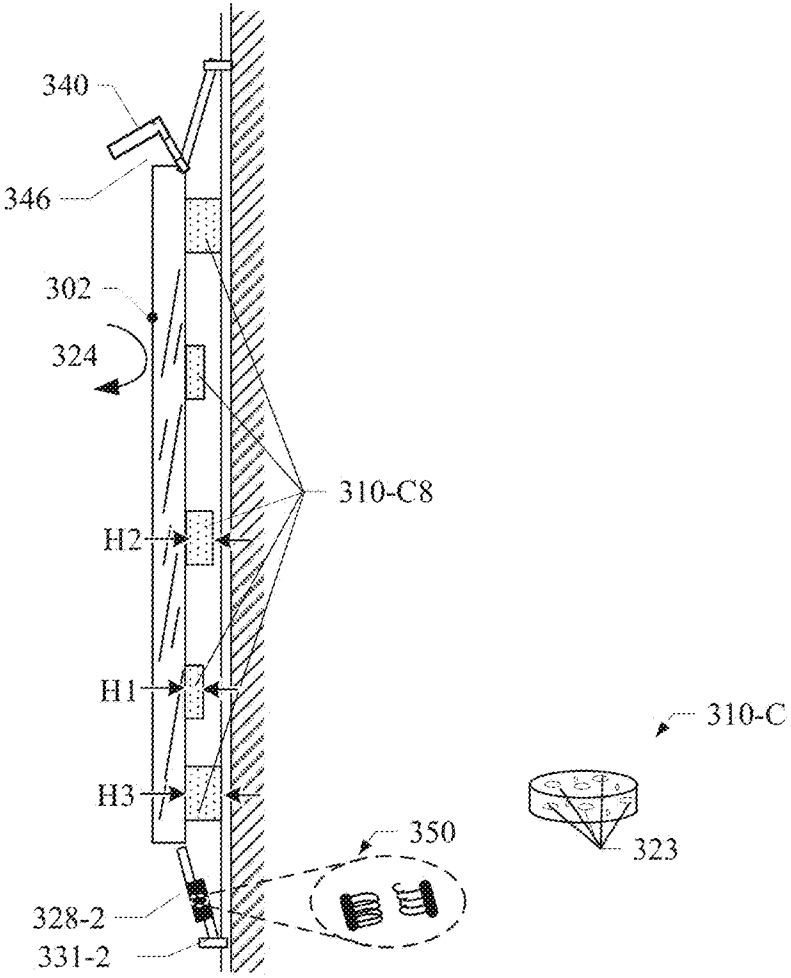
FIG. 3C3
FIG. 3C2
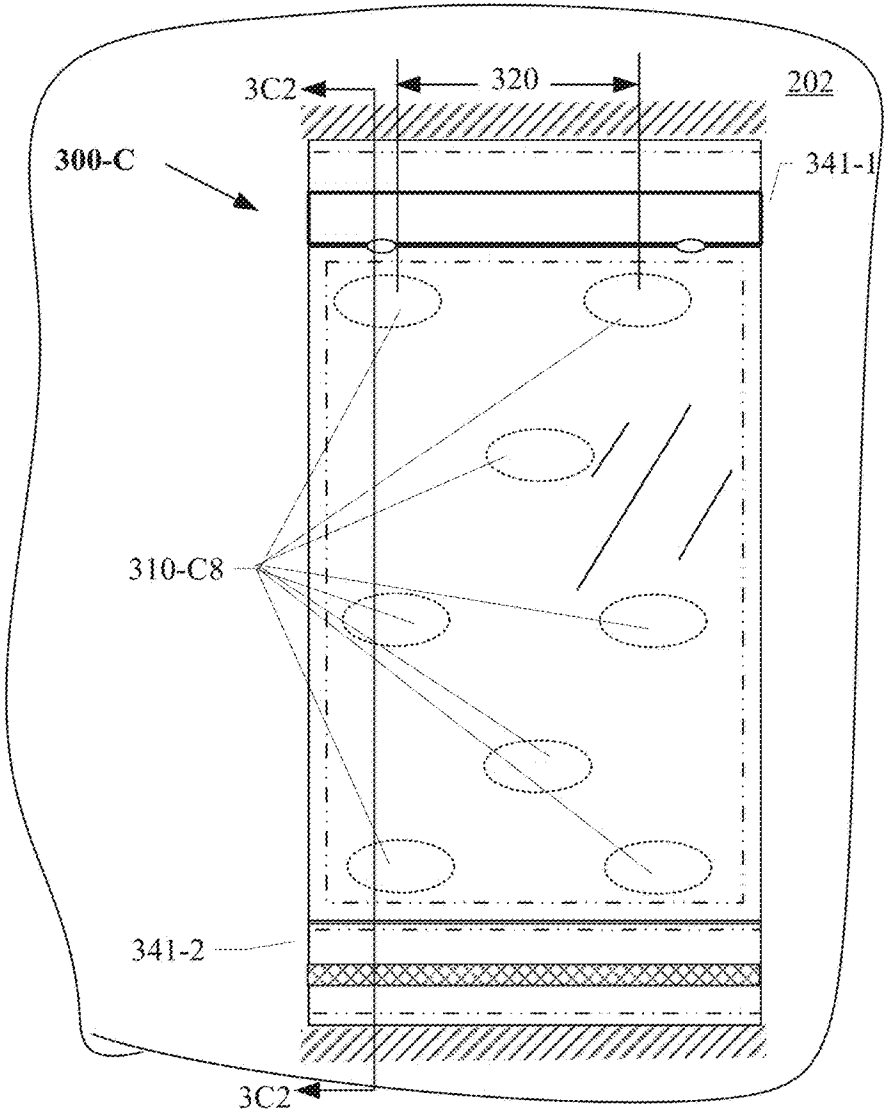
FIG. 3C1

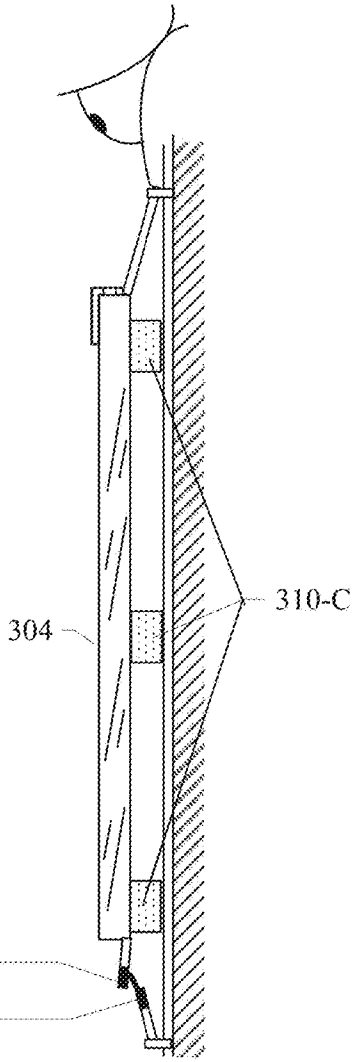
FIG. 3D2
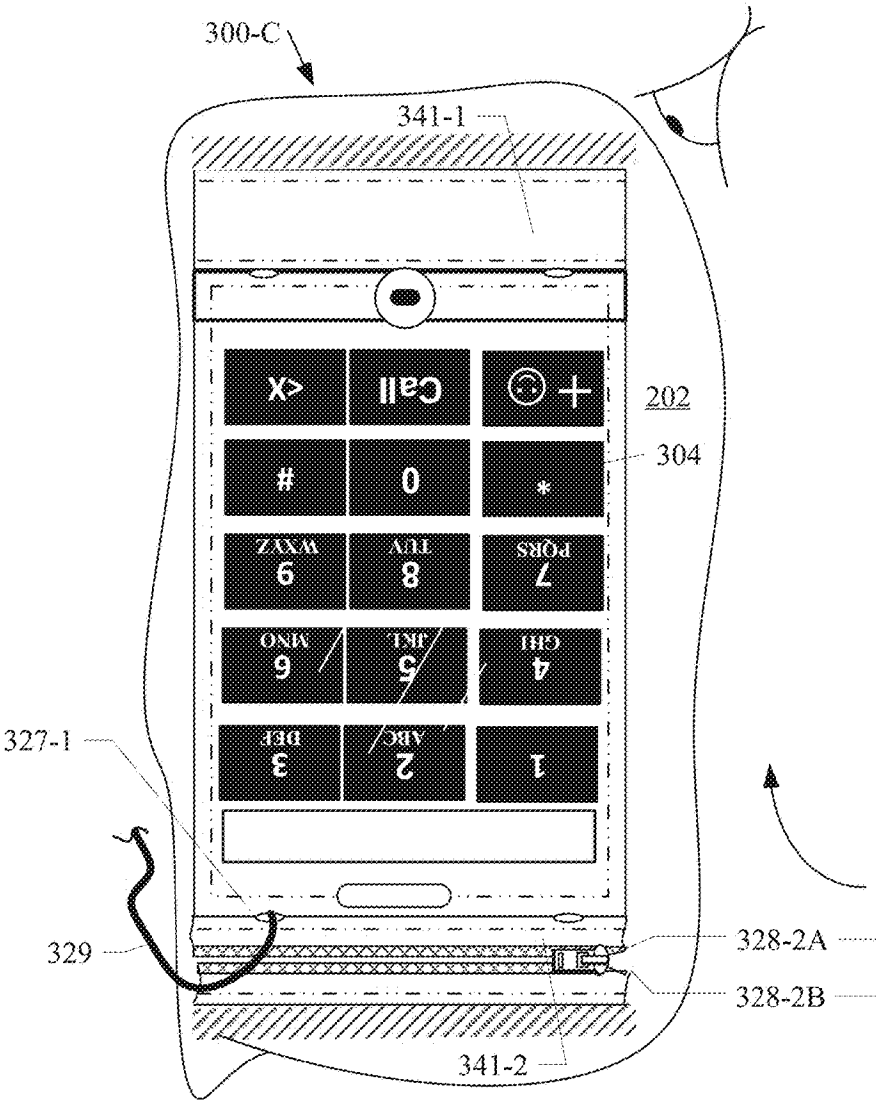
FIG. 3D1

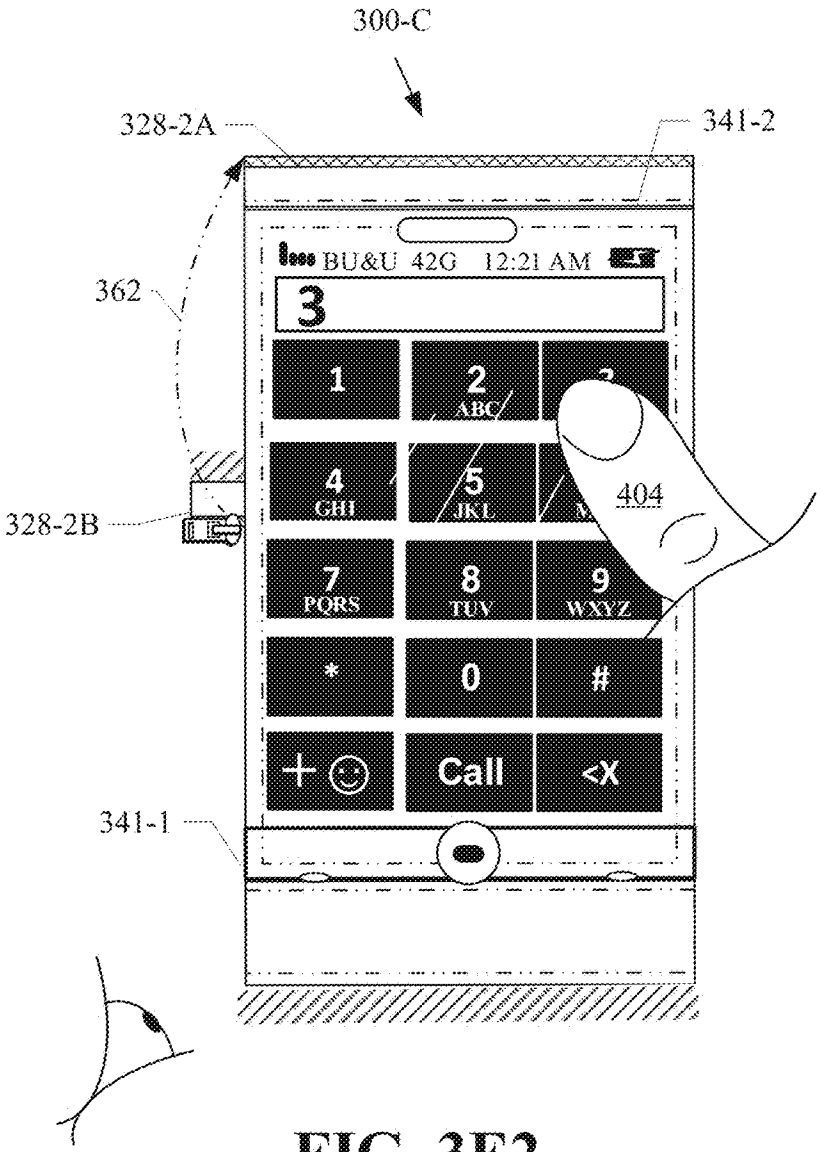
FIG. 3E2
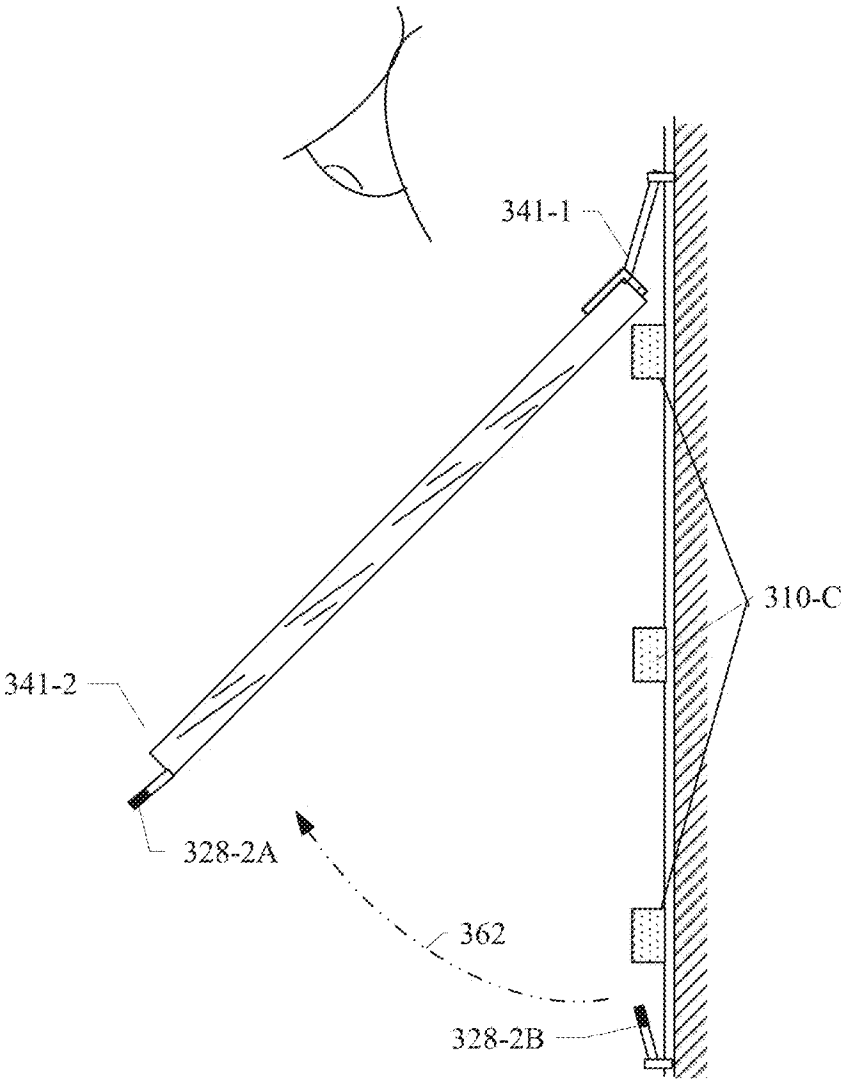
FIG. 3E1

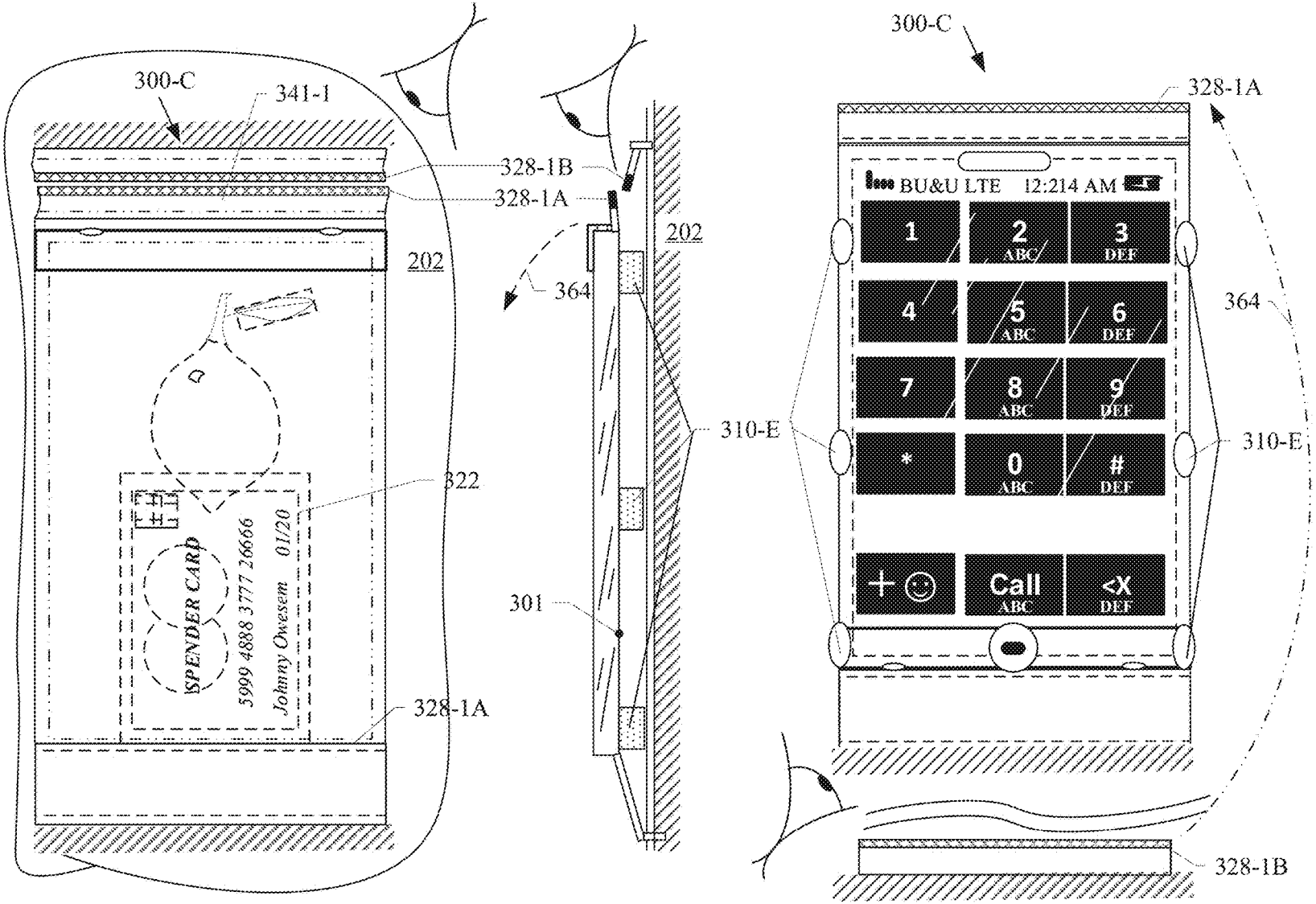
FIG. 3F1
FIG. 3F2
FIG. 3F3

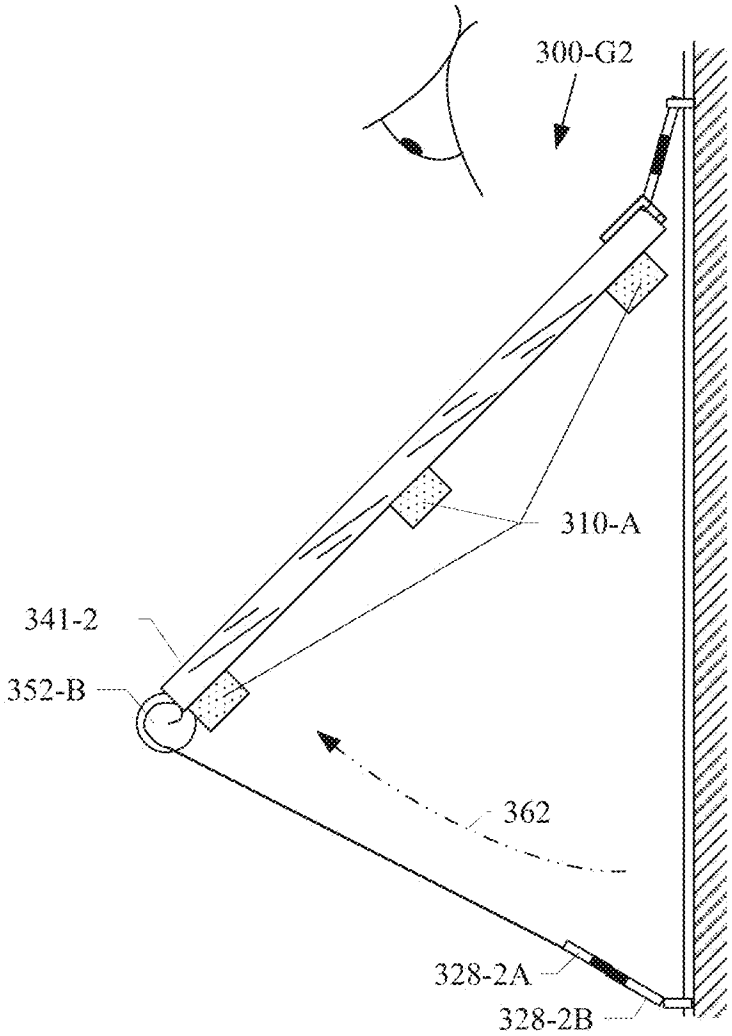
FIG. 3G2
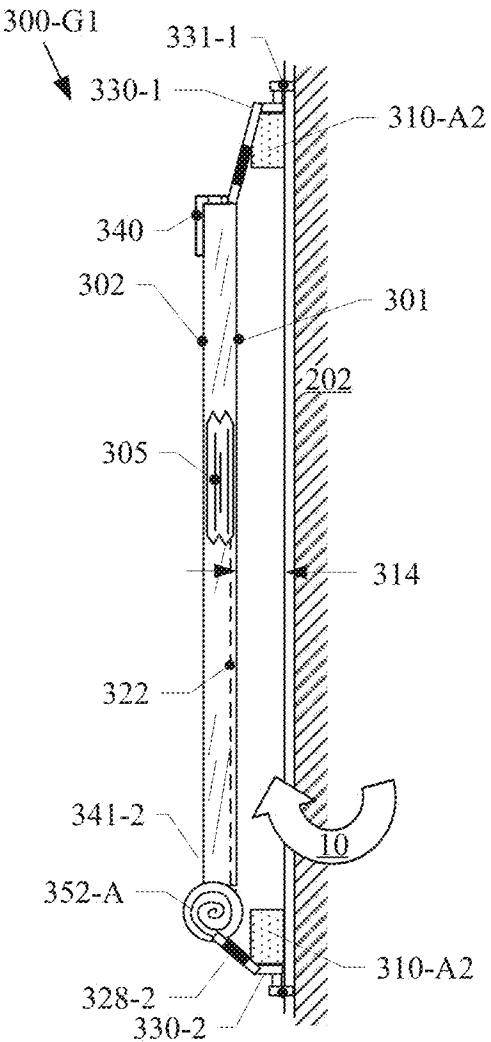
FIG. 3G1

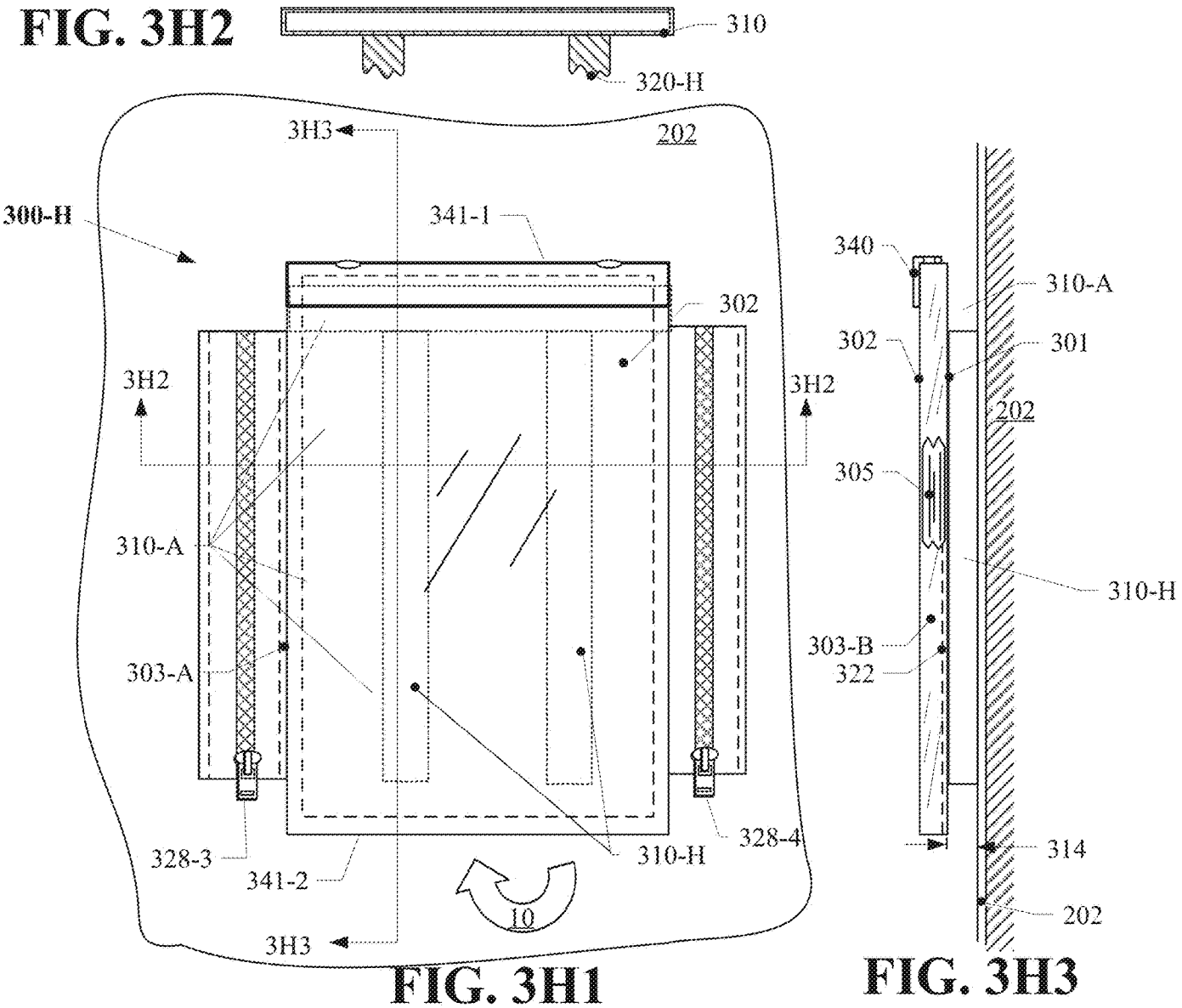
FIG. 3H2
FIG. 3H1
FIG. 3H3

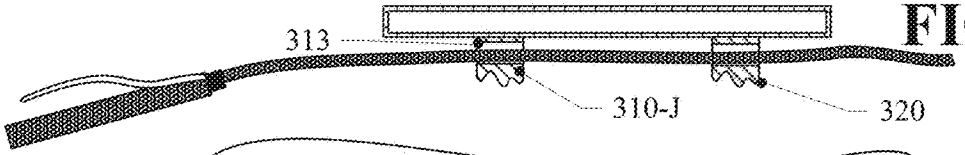
FIG. 3J2
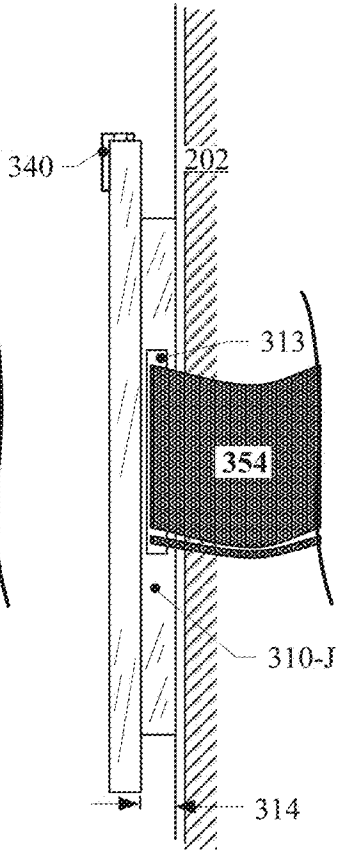
FIG. 3J3
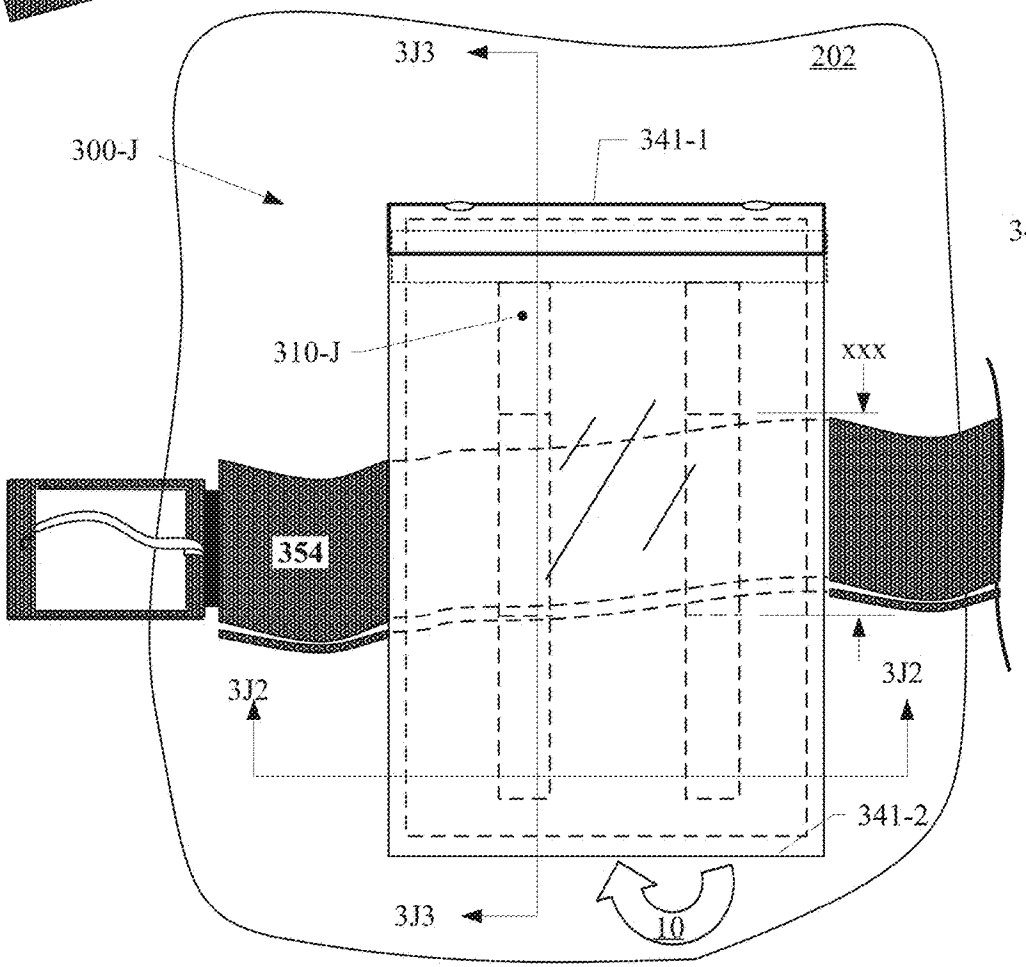
FIG. 3J1

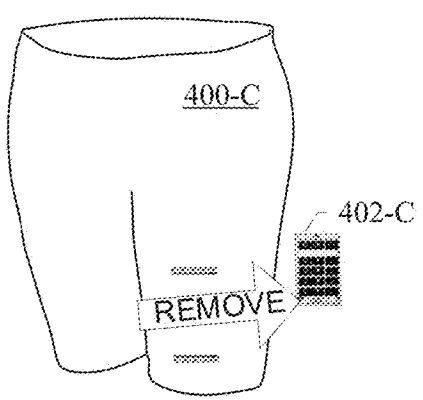
FIG. 4C
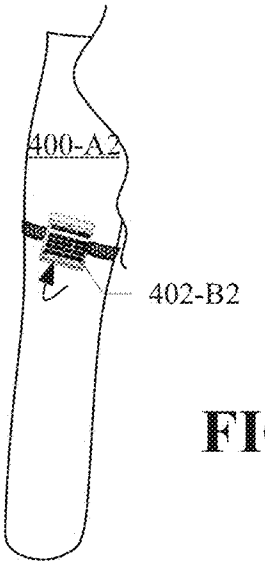
FIG. 4B2
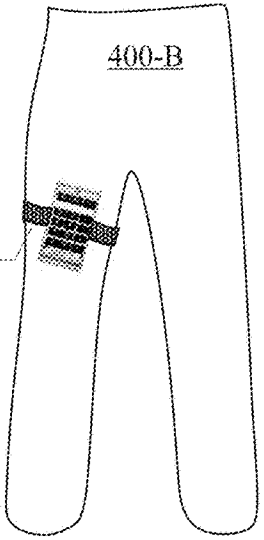
FIG. 4B1
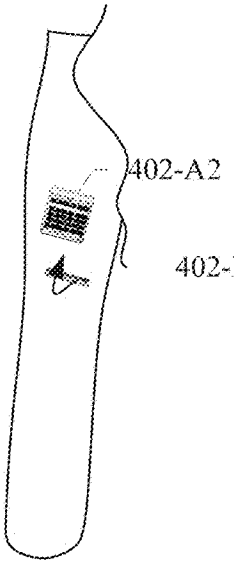
FIG. 4A2
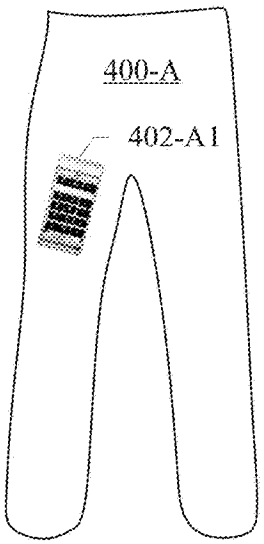
FIG. 4A1
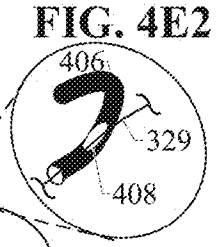
FIG. 4E2
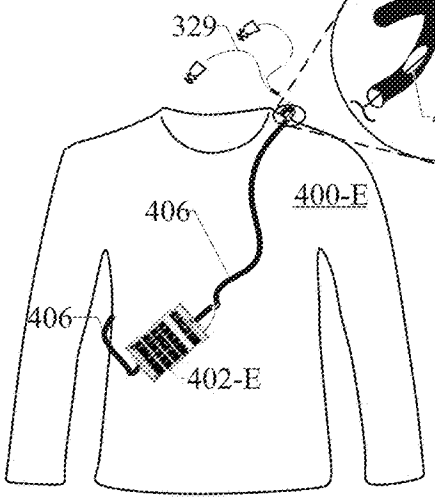
FIG. 4E1
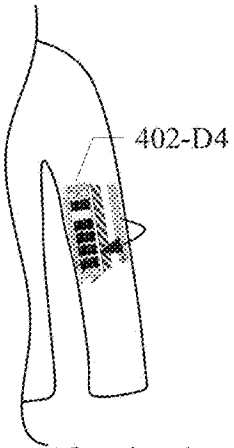
FIG. 4D4
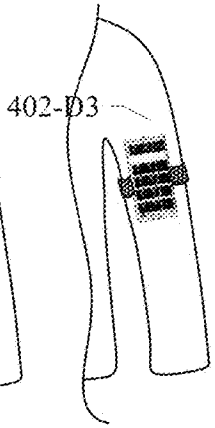
FIG. 4D3
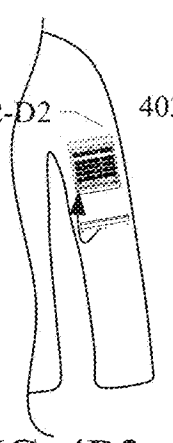
FIG. 4D2
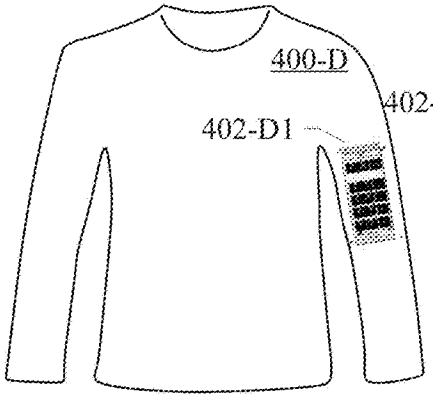
FIG. 4D1

POCKET FOR ARTICLES OR ELECTRONIC DEVICE

CROSS-REFERENCE TO RELATED APPLICATIONS

This application is a continuation of and claims priority to U.S. patent application Ser. No. 15/669,904 filed on Aug. 5, 2017, entitled "POCKET FOR ARTICLES OR ELECTRONIC DEVICE" for James L. Thompson, which claims priority to U.S. Provisional Patent Application Ser. No. 62/371,393 filed on Aug. 5, 2016, entitled "POCKET FOR ELECTRONIC DEVICE" for James L. Thompson; which applications are also incorporated by reference herein in their entirety for all purposes.

Furthermore, where a definition or use of a term in a reference, which is incorporated by reference herein, is inconsistent or contrary to the definition of that term provided herein, the definition of that term provided herein applies and the definition of that term in the reference does not apply.

FIELD OF TECHNOLOGY

This disclosure relates generally to the technical fields of clothing and garments, and in one example embodiment, this disclosure relates to a method, apparatus and system for securely retaining an electronic device in a pocket used in a dynamic environment, and for providing a convenient viewing and accessing of the pocket with comfortable ergonomics.

BACKGROUND

Pockets exist on many articles of clothing for holding or storing a wide variety of items, from car keys to wallets to electronic devices. On gym or workout attire, pockets are less frequently employed, if at all. This is because of the dynamic environment in which they are used. Loose articles in a pocket tend to fall out, or to slap irritatingly against a user who jogs, stair steps, plays racquetball or basketball, etc.

Some athletes use a specific independent holder that straps on to the user separate from their clothing. For example, a holder for an electronic device, such as a cell phone or an audio player, typically utilizes an elastic band that can be strapped to a user's arm. This holder usually has a firm fit over the cell phone device that it encloses, and the holder usually presses directly against the user's skin or clothing, in order to securely hold the contents, e.g., cell phone, and prevent excessive motion, e.g., during jogging. If the holder is strapped to a user's arm, it may be difficult to access the face of the electronic device, in order to operate it because either it is immovably strapped to the user, or the position, location, or orientation of the electronic device is not convenient for viewing by the wearer. In addition, some of these holders require an uncomfortable tightness of the circumferential strap in order to remain secure, thereby seeming more like a tourniquet than a holder.

If a user employs a holder for an article, such as an electronic device, during a strenuous activity, then a user will most likely be producing a substantial amount of perspiration and moisture during the activity. Some device holders utilize a waterproof casing to protect the electronic device from the perspiration and moisture, which might otherwise interfere with the operation of the electronic device or permanently damage the electronic device. As a result of the non-breathable pocket and/or electronic device resting directly against the garment worn, or against the user's skin, an uncomfortable wet patch forms thereunder.

SUMMARY

A pocket, garment, and method of using the pocket are disclosed. In one embodiment, the pocket includes a first layer as an interior layer of the pocket to face against the garment, a second layer as an exterior layer of the pocket, and one or more spacers coupled to the first layer of the pocket; and wherein: the one or more spacers offset or displace the pocket a given distance away from the garment. The purpose of the spacers is to promote air circulation between the pocket and the underlying garment and/or the user, and thus to resultantly provide a gap between an article stored in the pocket, such as a cell phone, music player, phablet, personal digital device, GPS, or non-electronic item, etc., ("Article") and the user.

With a typical pocket, a single layer or multiple layers of flat fabric, alone or in combination with a waterproof layer of material, are used to protect the Article, and are disposed between the Article and the user. Thus, user perspiration collects at the location where the Article rests against the user. This causes discomfort to the user, and possibly creates an excessively damp and hazardous environment for electronic Articles that are not moisture proof.

In one embodiment, the pocket includes one or more spacers, each of which has a size and location such that it allows fingers of the user's hand to be placed between the pocket and the user/garment such that the user can lift, rotate, or articulate the pocket for viewing and interacting with the electronic device stored therein. At least two of the one or more spacers are disposed laterally or vertically across the back of the pocket, in one embodiment. In another embodiment, at least one of the one or more spacers is composed of a breathable material.

The first and second layers of the pocket can be made of breathable material or of non-breathable, moisture proof material, the latter being acceptable since the pocket is not disposed directly against or on the user. The second layer, i.e., the exterior layer, is comprised of a material that is moisture resistant in one embodiment. The second layer of the pocket includes a window for viewing the article disposed inside the pocket, wherein said window is an opening defined by a cutout perimeter in the second layer or a transparent layer coupled to the balance of the pocket. The pocket includes a first end, which has a selective attachment means or a fixed attachment means, and a second end distal from the first end, which also has either a fixed attachment means or a selective attachment means, and any combination thereof. The balance of the pocket is free of attachment means in one embodiment to promote air circulation around the pocket. The selective attachment means sued for either end of the pocket is a zipper, snap, hook-and-loop fastener, or any other means that allows a selective attachment and removal of the pocket from its parent garment. The pocket also includes an access opening at one or end of the pocket to insert and to remove articles to be stored in the pocket. The article stored inside the pocket is only operable from outside the pocket in the present embodiment, meaning that the user's hand does not fit inside the pocket to operate the device therein. In an alternative embodiment, the pocket includes an elastic strap portion that is sized to a specific object, or a range of specific objects, to be disposed in the pocket. In other words, the pocket can be sized to elastically accommodate a range of common article sizes, such as cell phones of different sizes, and still tightly secure the different size articles in a single size pocket that has elastically hold large and small articles therein. The pocket includes means for disposing the pocket a distance away from a mating object to which the pocket will be attached in order to promote air circulation between the pocket and the mating object.

The pocket also includes, in one embodiment, a sleeve disposed between the first layer of the pocket and the second layer of the pocket for holding at least one plastic card, such as a credit card or an identification card. A positive enclosure disposed on the first end of the pocket retains the article securely inside the pocket. The pocket also includes mating halves of a selective attachment means (e.g., mating sides of a zipper for the first end and the second end of the pocket and garment, respectively), with each half coupled to either the pocket or coupled to a garment or a strap.

In a higher assembly, a garment includes all above embodiments and variations of the pocket, including attachment means that may be affixed to the garment itself. In addition, some or all of the spacers can be affixed to the garment rather than to the pocket.

Other features and advantages of the present disclosure will be apparent to those of ordinary skill in the art from the accompanying drawings and from the detailed description of the preferred embodiments that follows. Accordingly, the specification and drawings are to be regarded in an illustrative rather than a restrictive sense. The present invention is defined by the features of the appended claims.

BRIEF DESCRIPTION OF THE VIEW OF DRAWINGS

Example embodiments are illustrated by way of illustrations and are not limited by the figures of the accompanying drawings, wherein.

FIGS. 3A1, 3A2*a* and 3A2*b* are a front view and two side views, respectively, of a pocket for storing an article or electronic device, wherein the pocket has improved air circulation from being offset from the garment by multiple rows of spacers, according to one or more embodiments.

FIGS. 3A3*a*, 3A3*b*, 3A3*c*, 3A3*d*, 3A3*e*, and 3A3*f* are top views of a pocket for storing an article or electronic device, showing different profile embodiments of a bottom surface of a spacer for improved comfort and conformance to a wearer, according to one or more embodiments.

Figure 1:
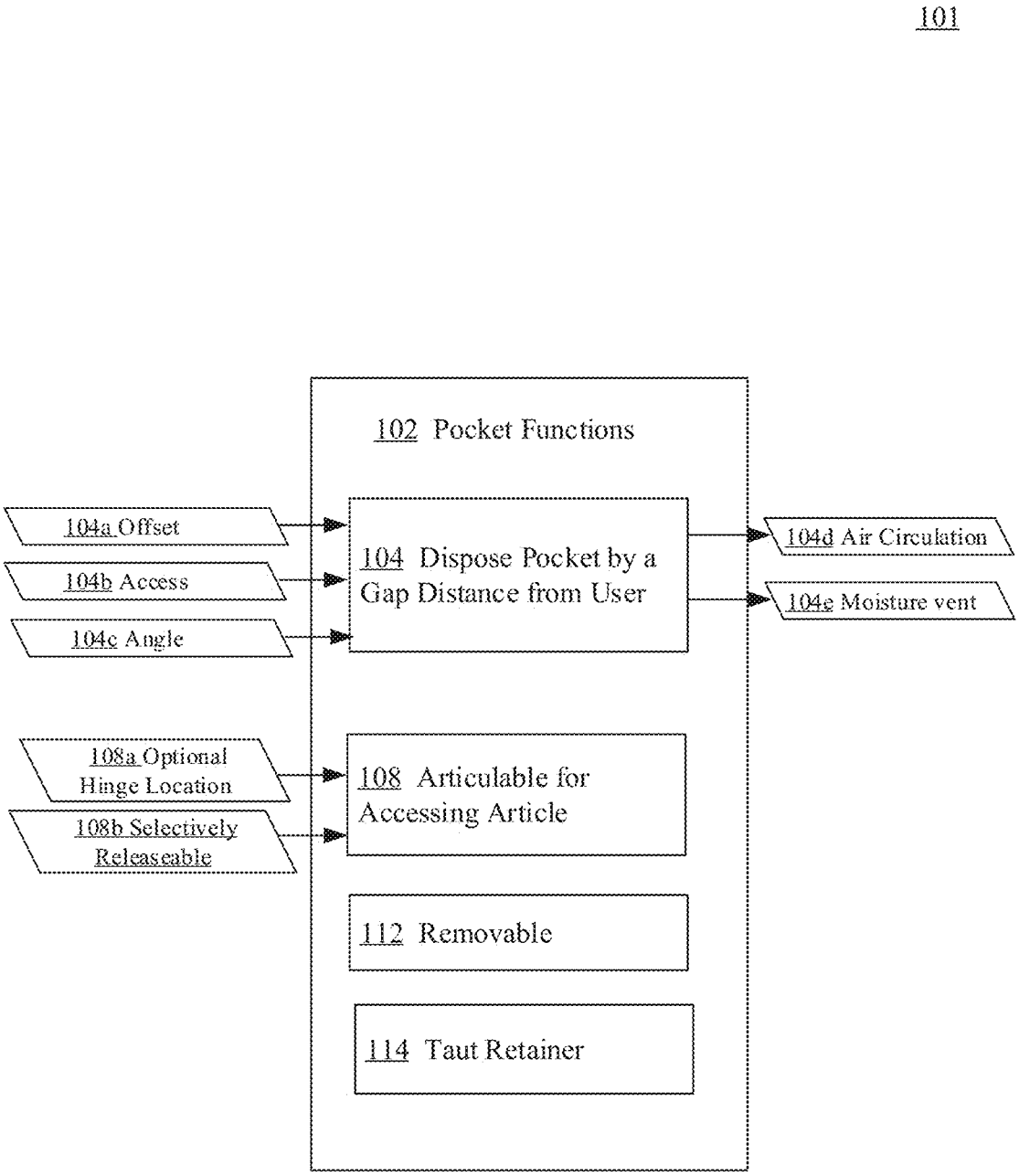
FIG. 1 is a block diagram of functions performed by a pocket for storing an article or an electronic device, according to one or more embodiments.

FIGS. 3B1-3B2 are a front view and a side view of a non-removable and non-hinged pocket 300-B for storing an article or electronic device, wherein the pocket coupled to a garment only by spacers disposed between the pocket and the garment, according to one or more embodiments.

FIGS. 3C1-3C2 are a front and side view of a pocket with circular cross-section distributed spacers, according to one or more embodiments.

FIG. 3C3 is an isometric view of an exemplary spacer made of a porous material for offsetting a pocket, according to one or more embodiments.

FIGS. 3D1 and 3D2 are a front view and side view, respectively, of a pocket for storing an article or an electronic device, wherein one end of the pocket is not selectively detachable but is hingably rotatable, and wherein the other end of the pocket is selectively detachable, according to one or more embodiments.

FIGS. 3E1 and 3E2 are a side view and a top-down view, respectively, of a pocket for storing an article or an electronic device, wherein the pocket is rotated in situ for access to an electronic device keypad, according to one or more embodiments.

FIGS. 3F1, 3F2, and 3F3 are a front and side view, and an isometric view of a hingably rotated pocket for storing an article or electronic device, wherein the device faces inward when pocket is coupled at both ends to the garment, according to one or more embodiments.

FIGS. 3G1 and 3G2 are a side view of a retracted spring-loaded coil and an extended spring-loaded coil, respectively, that elastically retains a second end of the pocket to a garment or strap, according to one or more embodiments.

FIGS. 3H1, 3H2, and 3H3 are a front view, top view, and side view of a pocket for storing an article or an electronic device, wherein the pocket has a selectively detachable means at both sides of the pocket, according to one or more embodiments.

FIGS. 3J1, 3J2, and 3J3 are a front view, top view, and side view of a pocket for storing an article or an electronic device, wherein the pocket has a loop for accepting a belt to retain the pocket to a user or object, according to one or more embodiments.

Figure 3K:
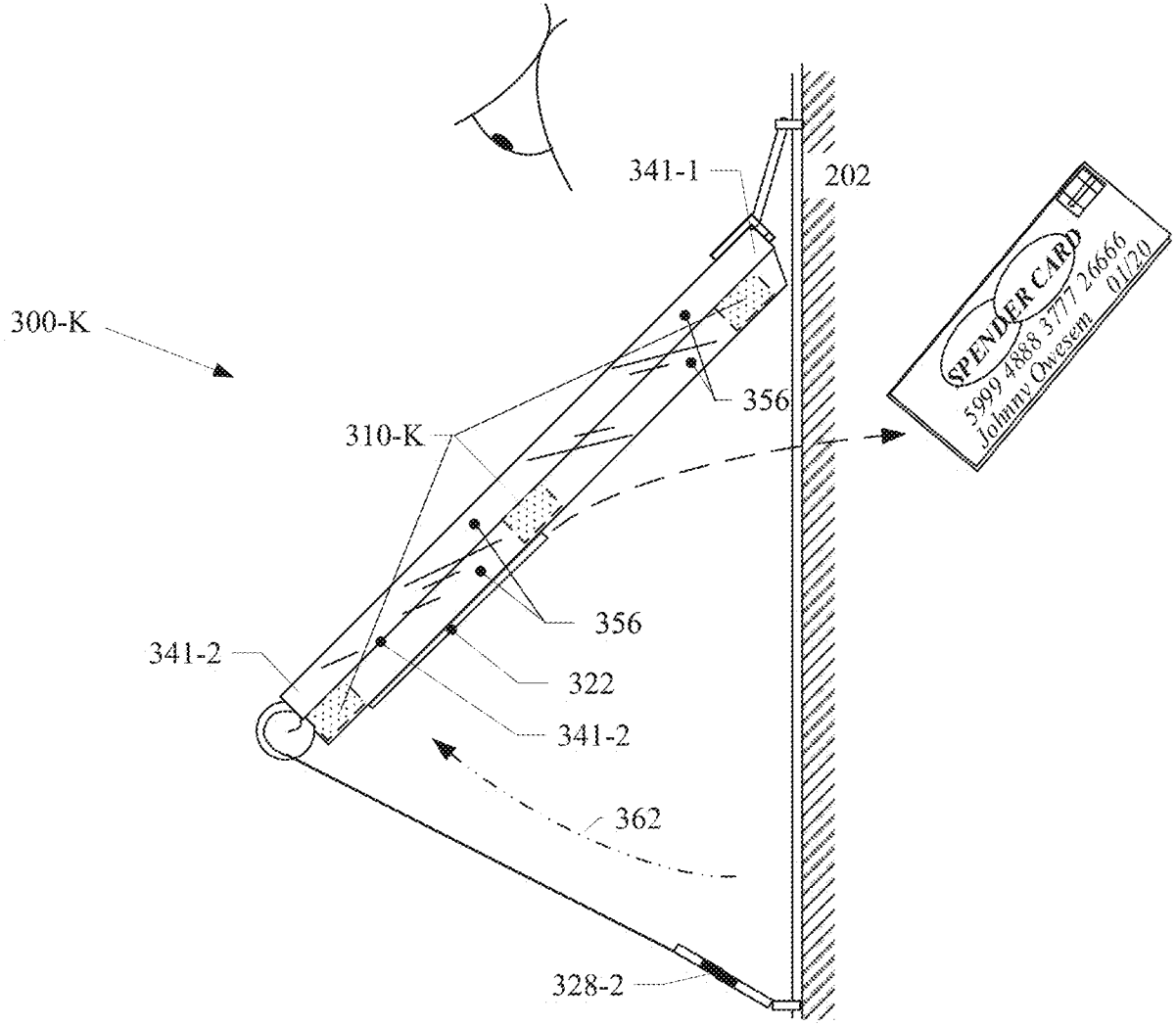

FIG. 3K is a side view of a pocket for storing an article or an electronic device, wherein fabric encloses the backside of pocket including spacers, according to one or more embodiments.

Figure 3L:
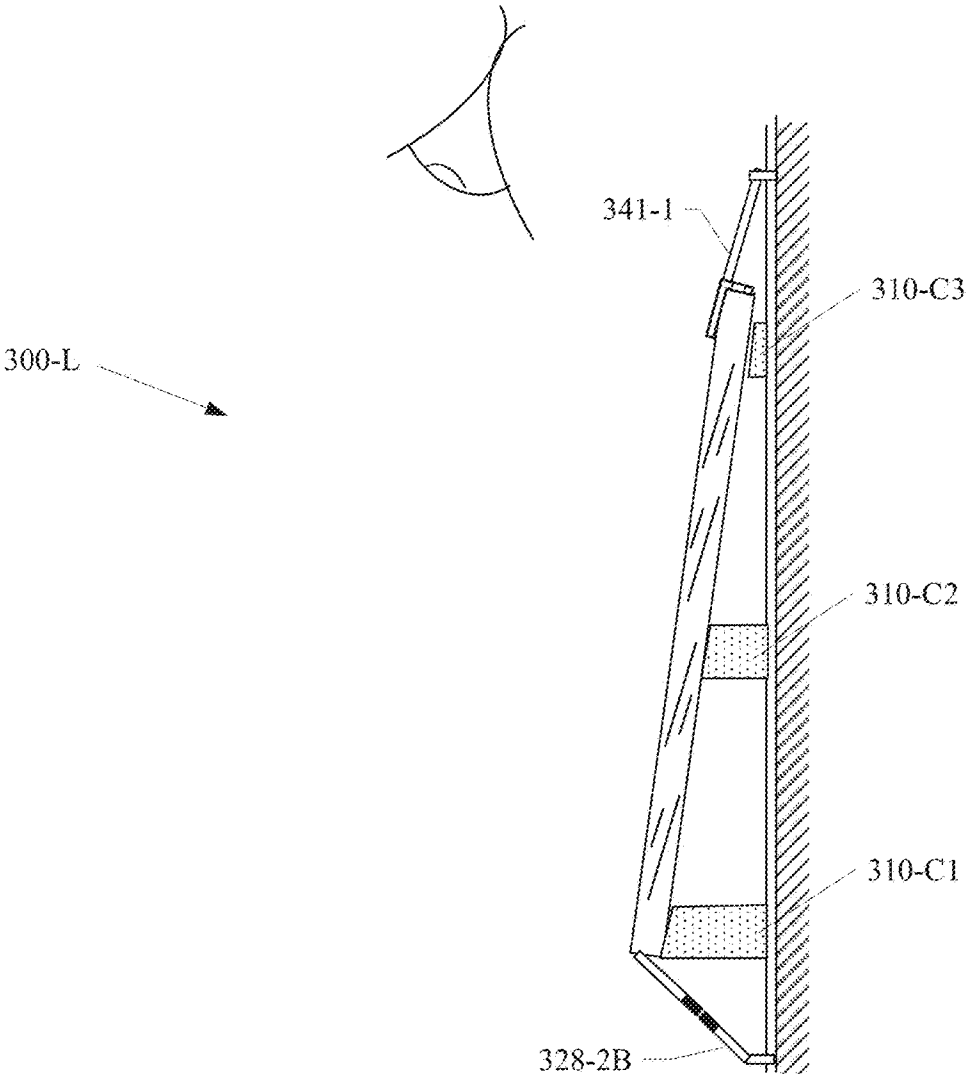

FIG. 3L is a side view of a pocket for storing an article or an electronic device, wherein the spacers vary in height across the length of the pocket, according to one or more embodiments.

FIGS. 4A1, 4A2, 4B1, 4B2, 4C, 4D1, 4D2, 4D3, 4D4, and 4E1 are front views of different garment applications for a pocket in which to store an article or an electronic device, wherein the pocket has spacers for breathability and the pocket has different configurations of retention to the garment or a strap, according to one or more embodiments.

FIG. 4E2 is a front view of a strap with an access hole for threading an electronic wire therethrough, according to one or more embodiments.

The drawings referred to in this description should be understood as not being drawn to scale, except if specifically noted, in order to show more clearly the details of the present disclosure. Same reference numbers in the drawings indicate like elements throughout the several views. Other features and advantages of the present disclosure will be apparent by reference to the detailed description when considered in conjunction

DETAILED DESCRIPTION

A pocket, a garment, and a method of using the pocket are disclosed. In the following description, for the purposes of explanation, numerous specific details are set forth in order to provide a thorough understanding of the various embodiments. It will be evident, however to one skilled in the art that various embodiments may be practiced without these specific details.

Function Block Diagram

Referring now to FIG. 1, a block diagram is shown of functions performed by a pocket for storing an electronic device, according to one or more embodiments. Pocket functions 102 include means for disposing the pocket a gap distance 104 away from a user and/or the user's garment. Inputs for the gap distance function 104 are a means for offsetting 104*a* the pocket from the user; a means for accessing 104*b* the pocket by a user easily and conveniently by positioning a user's hand behind, around, or on the side of the pocket for selectively moving, detaching, or articulating the pocket for viewing, accessing, or for exchanging data with the contents stored in the pocket, presumably an electronic device in the present embodiment; and a means for arranging the offset pads on an angle 104*c* to ergonomically mate with a user's hand position and size.

Another function of the pocket is a means for articulating 108 the pocket for accessing or viewing of the article within the pocket, e.g., an electronic device. The articulating function is swiveling, rotating, angling, twisting, hanging, and otherwise manipulating the pocket for viewability, storage, or data exchange purposes with the device stored in the pocket, including viewing data and exchanging data using tactile, haptic, voice command, etc. mediums. Embodiments below indicate that this is accomplished using cloth, fabric, elastic, and other types of flexible material that are attachable to a pocket and a garment, either with selectively removable or non-removable attachment embodiments. Functional input 108*a* is an optional hinge location, wherein the articulating means can be disposed on a top end, a bottom end, or a side of a pocket, allowing for articulating in different axes. The input function of being selectively releasable 108*b* can be accommodated by any detachable and reattachable fastening means, such as hook and loop, zipper, etc.

In one embodiment, the pocket has a means for selectively removing 112 the pocket as a whole for portability, cleaning, servicing, etc. This function benefits from the selectively releasable input 108*b*. In addition, the pocket has a means for elastic, or taut, retaining 114 for secure holding and placement of the pocket without excessive motion or slapping from a static or dynamic gap between the pocket and the user. This feature is to prevent excessive motion and irritating pocket movement during physical activity of the user of the pocket. In other words, normal body motions involve acceleration of body parts in different directions, especially for exercising. The acceleration and deceleration cause forces in the direction of the acceleration and deceleration that might cause the pocket to float, jump, or shift, due to a mass of the contents within the pocket. For example, a lightweight thin glove in a pocket has little mass, and thus, little force exerted when the glove is accelerated in different directions. A heavy mobile cellular device, on the other hand, will cause substantial forces, when it is accelerated and decelerated in different directions. The means for elastic, or taut, retaining 114 will compensate, ameliorate, or otherwise mitigate the effects of any unwanted or annoying movement of the pocket and the article therein.

The means for hingably articulating the pocket is harmonious and complementary with the means or selectively removing the pocket and the mean for providing a gap distance from the user for air circulation between the pocket and the garment/user.

Figure 2A:
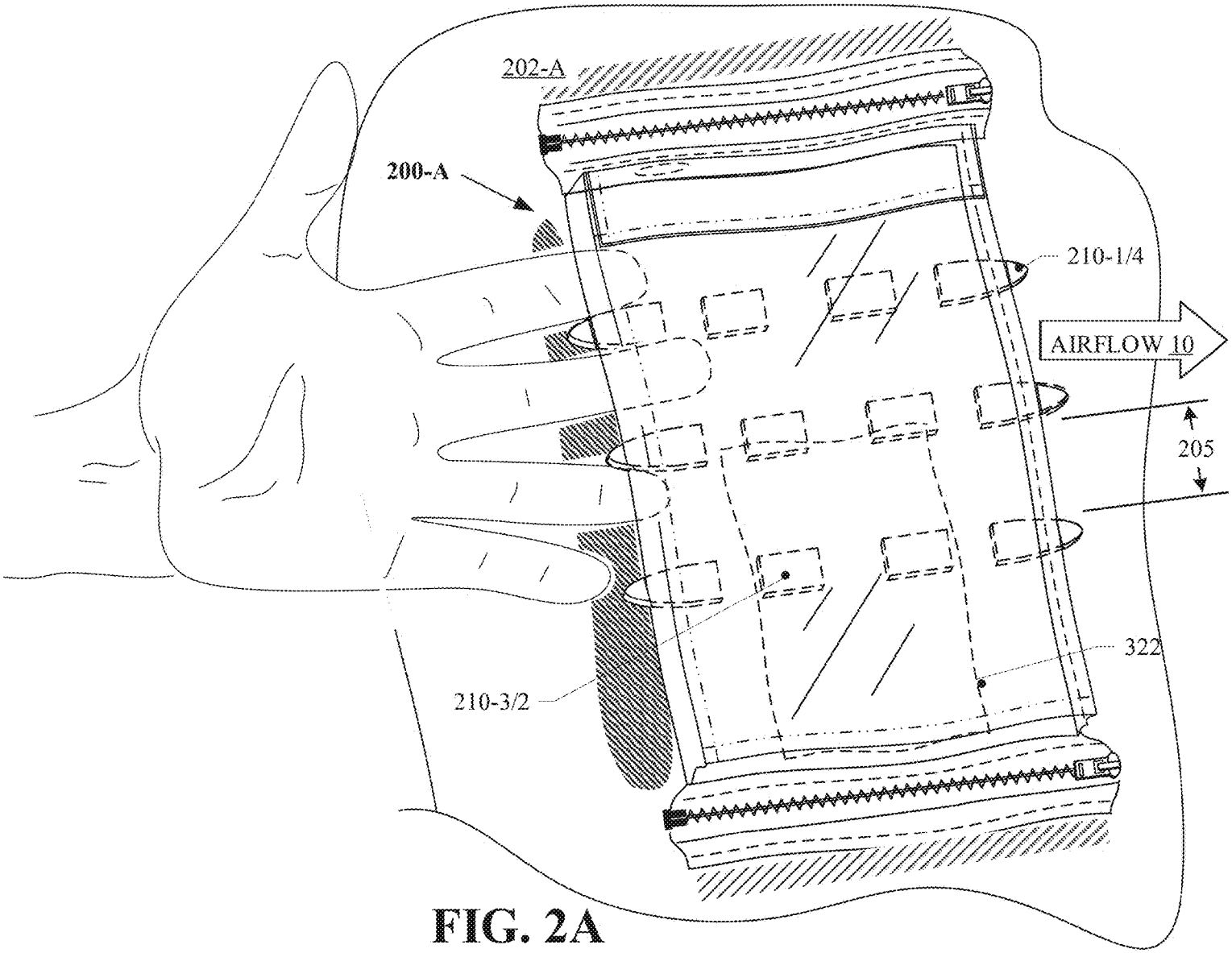
FIG. 2A is an isometric view of a pocket for storing an article or electronic device, wherein the pocket is coupled to, and offset by an array of spacers from, a garment, according to one or more embodiments.

Referring now to FIG. 2A, an isometric view is shown of a pocket 200-A for housing an article or electronic device, wherein the pocket is coupled to, and offset from a garment 202-A by an array of spacers, according to one or more embodiments. As shown, an exemplary user's index and middle finger navigate, or position, around the row of spacers, including top right spacer 310-1/4 ($1^{st}$ row, $4^{th}$ column of spacers). Inter-row spacing 205 is chosen ergonomically for this purpose, with different pocket designs for different user dimensions, e.g., size of hand, width of fingers, gender of user, and age of user. If the pocket is selectively attachable to a garment, then a custom pocket can be selected based on the user's anthropometry and biometrics.

Figure 2B:
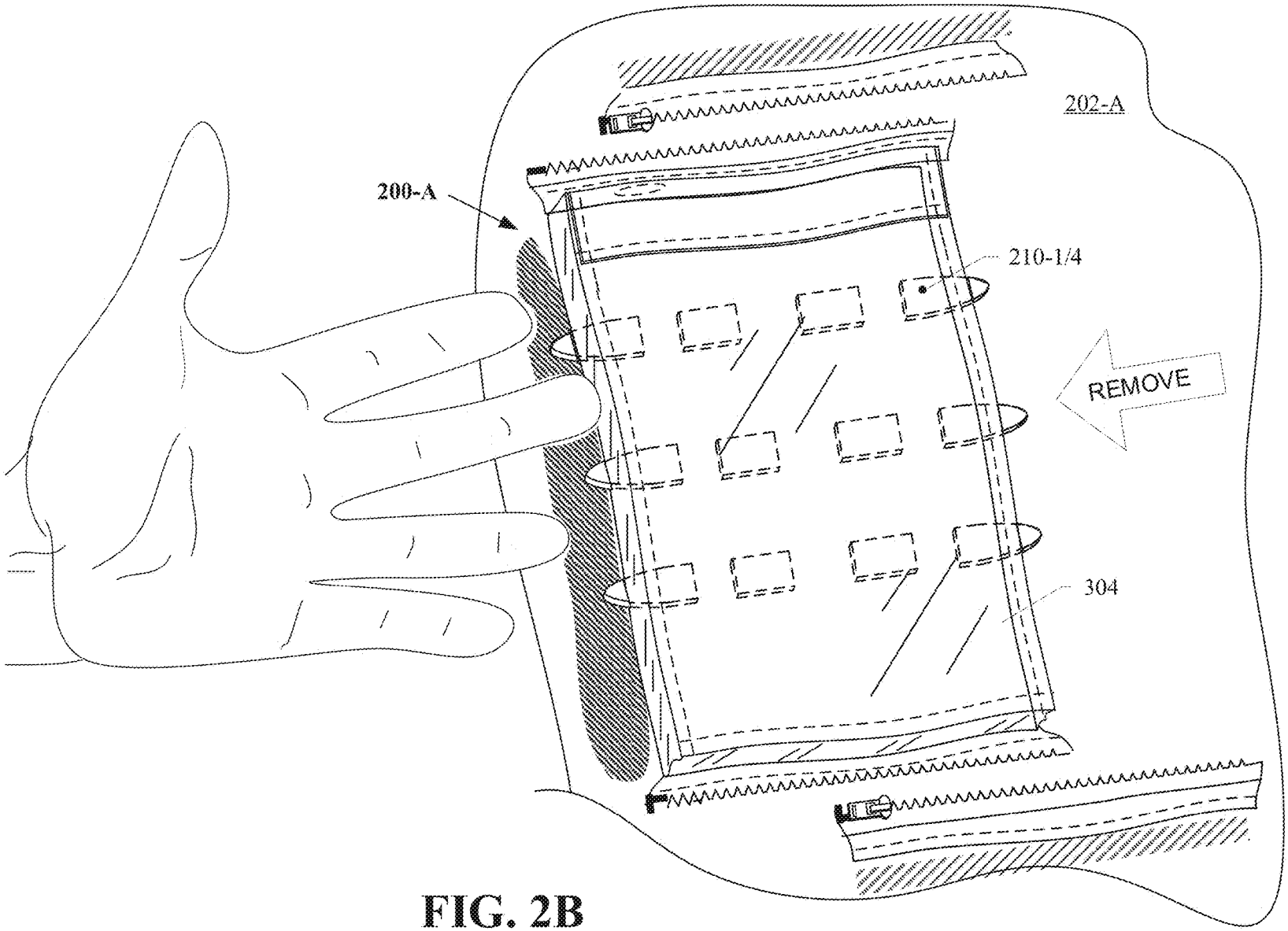
FIG. 2B is an isometric view of a pocket for storing an article or electronic device, wherein the pocket is selectively removable from a garment, according to one or more embodiments.

Referring now to FIG. 2B, an isometric view is shown of a pocket 200-A for retaining or storing an article or an electronic device, wherein the pocket is selectively removable from a garment 202-A, according to one or more embodiments. Removing the pocket allows separate cleaning of the pocket, or application to one or more different garments. For example, the removability of pocket 200-A allows for specialized user-specific size and feature of pocket can be selected and inserted on a standard baseline garment or application based on the user's specific features. An optional sleeve 322 is disposed inside or outside the pocket, for retaining a user's driver license, health club membership card, credit cards, and the like. In the present embodiment, spacers 210 are coupled to the pocket 200. However, in another embodiment, spacers 210 are coupled or attached instead to garment 202-B.

Figure 2C:
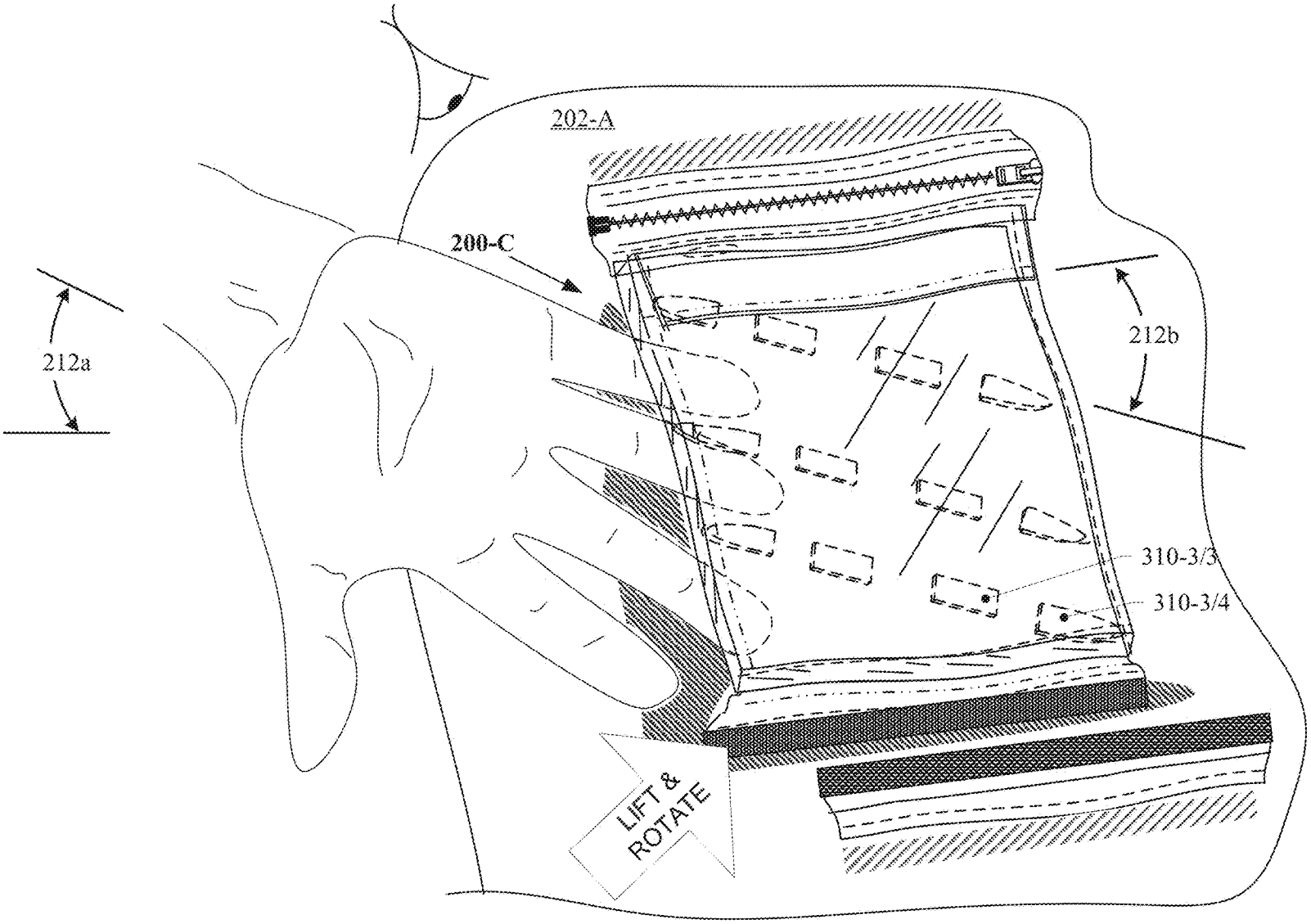
FIG. 2C is an isometric view of a pocket for storing an article or electronic device, wherein the pocket is selectively pivotable on, or hingably attached to, a garment, according to one or more embodiments.

Referring now to FIG. 2C, an isometric view is shown of a pocket 200-C for storing an article or electronic device, wherein the pocket is selectively pivotable on, or hingably attached to, a garment 202-A according to one or more embodiments. In the present embodiment, the rows, e.g., bottom row of offset spacers including pads 310-3/3 and 310-3/4, are oriented at an angle 212*b* with respect to the horizontal plane, e.g., the top or bottom of the pocket when considering the upright or normal orientation of a garment or application, such as standing or sitting. Angle 212*b* matches a frequently implemented angle 212*a* of the user's hand when accessing the pocket 200-C, e.g., when a user is reaching the pocket from a standing position, or from a seated position, then hand comes in at an angle. The rows of spacers are parallel to each other in one embodiment, and in another embodiment are slightly offset or angled with respect to each other to emulate the fanning out of the fingers from a locus of the palm of the hand. In this manner, the user's hand can easily and conveniently engage the means for accessing the pocket in order to rotate, manipulate, etc. the pocket for viewing and exchanging data with the device therein, e.g., a cell phone. The eye icon in the figures represents the perspective of a user/wearer of pocket 200-C, as the user/wearer is standing, sitting, walking, etc., and wants to view contents of pocket 200-C disposed on the front of a workout pant leg.

FIGS. 3A1, 3A2*a* and 3A2*b* are a front view and two side views, respectively, of a pocket 300-A for storing an article or electronic device, wherein pocket 300-A has improved air circulation 10 by being offset from garment 202 via multiple rows of spacers 310-A, according to one or more embodiments. Pocket 300-A comprises a first layer 301, which provides an interior layer of the pocket that faces against the garment and/or the user's skin directly under the garment, when the pocket is in a fastened down state against the garment; a second layer 302, which is an exterior layer of the pocket that faces outward from the garment and/or user when the pocket is in the fastened down state against the garment; and one or more spacers 310-A that are coupled to first layer 301 of the pocket 300-A, or to the garment 202. First layer 301 and/or second layer 302 are composed of breathable material 325 in one embodiment to allow a heat to escape from an electronic device housed within the pocket, i.e., by some airflow 10 therethrough. In another embodiment, first layer 301 and/or second layer 302 are moisture-resistant (e.g., using a PTFE layer) or are moisture proof and/or are hermetically impermeable, e.g., plastic, for wet or hazardous environments. Another embodiment provides a hybrid of a moisture resistant material in exterior second layer 302 for ambient conditions and provides a breathable second inner layer 302 for heat dissipation.

Pocket 300-A includes one or more spacers 310-A. The one or more spacers 310-A offset pocket 300-A a given distance 314 away from a mating object, e.g., garment 300-A worn by a user, to which the pocket will be attached in order to promote air circulation 10 between the pocket and mating object, e.g., 300-A. Spacers 310-A have a given width 316 such that it can be spanned by two adjacent human digits, i.e., the spacer fits between two adjacent fingers. Alternatively, the intra-spacer width, or gap, 318 is wide enough in another embodiment for one or more digits of an average user, or of a specialized user, e.g., a tall female teen, or a stocky adult male. In one embodiment, at least one of the spacers is disposed laterally across the pocket, in a horizontal plane. In another embodiment, at least one of the one or more spacers is composed of a breathable material. Spacers are fixedly coupled to second layer 301 of pocket with bottom surface 320 floating on surface 204 of fabric of base garment 202. This allows for movement of the garment against the spacers and thereby provides more comfort for user, say involved in a strenuous sport. A more traditional pocket might place the article in the pocket directly and rigidly positioned against the garment and the user, completely immobilizing it due to the footprint of the pocket, or electronic device therein with little ability to accommodate flexing and shape changes of user's muscle and tissue. It is possible that pocket 300-A could have a single spacer, that is laterally placed between the selective attachment means at first end 341-1 and second end 341-2, though the pocket might wobble. In the embodiment shown, four lateral spacers 301-A are used, spaced approximately equidistant between first end 341-1 and second end 341-2. Spacers can have different heights depending on their location, e.g., shorter height spacers in the middle and taller ones at the end—to account for thigh muscle, over which the pocket will sit, has a curvature that is higher in the middle of the pocket area. Similarly, vertically oriented spacers can have varying heights.

The second layer 302 in one embodiment has a window 304 for viewing the article disposed inside the pocket (shown in FIGS. 2B and 3D1); and the first layer is comprised of a breathable material. Window 304 in one embodiment is an opening defined by an interior perimeter cutout of second layer 302 that allows direct contact with the article stored in pocket 300-A, e.g., the keyboard of a cell phone. Alternatively, window 304 is a transparent material, e.g., plastic, spanning the opening in second layer 302, that is touch sensitive to allow data communication with the device stored in pocket 300-A. The second layer that is the exterior layer is comprised of a material that is moisture resistant 324 in one embodiment. Spacer has a bottom surface profile 320-A as shown in FIG. 3A3*a* in one embodiment, with other embodiments provided in subsequent FIGS. 3A3*b* to 3A3*f*.

Pocket 300-A includes a first end 341-1 having an optional selective attachment means 328-1 that is selectively attachable and detachable, e.g., snaps, hook and loop fastener, buttons, etc.; and a second end 341-2 that is distal from first end 341-1 a distance 344-A and which has a similar optional selective attachment means 328-2. The balance of the pocket, e.g., sides 303-A and 303-B, are free of attachment means in the present embodiment in order to promote air circulation 10 around the pocket and to enable easy access to a backside of pocket for manipulating the pocket. The selective attachment means for the first end of the pocket and the second end of the pocket is an individual zipper in the present embodiment, but can be any means of selectively coupling and decoupling the pocket to a garment.

The article stored inside pocket 300-A is operable from outside the pocket 404. In other words, there is insufficient space in the actual pocket to fit user's hand therein for operation of the electronic device or article held in the pocket. The pocket includes an elastic strap portion 305 on a sidewall of pocket that is sized to a specific object, e.g., a music player, or a range of objects, e.g., large to small smart phones, to be disposed in the pocket. An access hole 327-1 in either side (L or R) of first end 341-1 and/or second end 341-2, or on side wall(s) 303 provides access for legacy wired devices such as earbuds, synch cable, and/or charging cords.

Still referring to FIG. 3A1, selective attachment means 328-1 and 328-2 are coupled to: a garment-interface piece 330-1 and 330-2, on first end 341-1 and second end 341-2, respectively, which in turn are coupled to garment 202 or some other application via attachment point 331-1 and 331-2, e.g., stitching, adhesive, or the like; and a pocket interface piece 326-1 and 326-2 which itself is coupled to top, or first, end 341-1 and bottom, or second, end 341-2, respectively of pocket 300-A. Exemplary eyelet tabs 315 are disposed at top, or first, edge 341-1 and/or at bottom edge 141-2 of pocket 300-A for securing pocket 300-A to a user or a garment, with one or two eyelets on top or bottom, or any combination thereof. By attaching pocket 300-A directly to the garment, whether selectively removable or non-removable, the present disclosure avoids a circumferential strap for holding pocket to user, which often turns out to be more of a tourniquet.

Pocket 300-A includes sleeve 322A disposed between the first layer of the pocket and the second layer of the pocket for holding at least one card, such as a driver's license, magnetic badge, medical card, credit card, etc. Pocket 300-A also includes a means for positive enclosure 340, such as a flap with a hook-and-loop fastener, button, zipper, mating magnets, etc. interface that is disposed on first end 341-1 of pocket 300-A in order to securely retain the article inside pocket 300-A, in one embodiment.

Referring now to FIG. 3A2*b*, a side view is shown of a pocket 300-A2 with spacers disposed at the attachment points of the pocket to the garment, and not disposed under the back of the pocket itself, according to one embodiment. Spacers 310-A2 provides support at first end 341-1 and second end 341-2 of pocket 300-A2. Thus, the substantial space behind the length 344-B of pocket 300-A2 provides superior air circulation, and superior accessibility of a user's hand to reach behind pocket 300-A2 to rotate it, remove it, or access contents therein, e.g., a cell phone screen. Selectively attachable means 328-2 comprises overlapping and/or mating parts, each with hook and loop fastener, mating magnets, mating zipper halves, etc. These mating parts will automatically reattach when user releases pocket 300-A2 from a tilted-up position and pocket 300-A2 falls back to rest, due to gravity, against garment with mating parts of hook and loop fasteners automatically re-engaging each other and retaining pocket 300-A2 against garment 202.

Referring now to FIGS. 3A3*a*, 3A3*b*, 3A3*c*, 3A3*d*, 3A3*e*, and 3A3*f*, top views are shown of pocket for an article or electronic device, with different profile embodiments of a bottom surface of a spacer for improved comfort and conformance to a wearer, according to one or more embodiments. FIG. 3A3*b* is a flat and level profile 320, which is sufficient for a baseline design, and for average applications and duration of wearing pocket, etc. However, superior comfort is attainable using embodiments in FIGS. 3A3*c*, 3A3*d*, 3A3*e*, 3A3*f*, which all have a contoured profile 320, which is likely to be more conformal and provide more comfort and utility to a user than the flat profile 320 of FIG. 3A3*b*. Note the different radii 348-3, 348-4, and 348-5 in the different embodiments will accommodate different sizes and shapes of an interface, e.g., different sizes and shapes of a user such as a slim or a muscular arm, leg, thigh, etc. In one embodiment, all spacers use a same radii, regardless of their vertical or horizontal placement on pocket between first end 341-1 and second end 341-2. However, in another embodiment, the radii of spacers 310 change depending upon the location of the spacer, both vertically and horizontally. For example, the radii shown will account for the lateral curvature of a muscle, which itself changes depending on the vertical location on a user, e.g., a larger radii for a spacer closer to first end 341-1 (closer to user's waist where the thigh is flatter), and a smaller radii for a spacer closer to the second end 341-2 (closer to user's patella, where the quads are more curved). Also, note the different embodiments of smoothness, e.g., 320-C, or waviness, i.e., 320-F, for personal preferences of a user for comfort, breathability, and fit. Land 345 exists where a radii does not extend a full width of spacer 310. Any height of spacer can be used that provides a clearance between the user/application and the pocket, such as heights 310-B, 301-D, and 310-F.

Referring now to FIGS. 3B1-3B2, a front view and a side view is shown of a non-removable and non-hinged pocket 300-B for an article or electronic device, wherein the pocket is coupled to a garment only by spacers 310-B disposed between the pocket and the garment, according to one or more embodiments. In this embodiment, spacers are permanently attached, via adhesive, stitching, melting, or other fastening means, to pocket 300-B and to garment, thus providing cooling airflow, or circulation, 10 between garment 202 and pocket 300-B, while simplifying the pocket/garment assembly, and saving cost and repair hassles for selectively removable fasteners. Because selectively detachable means are not utilized in this embodiment, pocket rotation is provided by disposing a plurality of spacers 310-B are provided only toward one end of the pocket, which is the top half of the pocket by end 341-1 in the present embodiment. The resulting gap 314 between pocket 303-B and garment 202 provides cooling and comfort to the wearer, while the open back of pocket 300-B at bottom end 341-2 allows ample clearance for a user's hand to manipulate the pocket from behind for viewing and exchanging data on a cell phone therein. The flexibility of garment 202 material, e.g., spandex, will also allow additional rotational movement. Thus, while the present embodiment will not rotate a full perpendicular angle to the surface of garment 202, it will nonetheless be able to swivel out at angles between 15, 20, 25, 30 and approximately 35 degrees and more, as measured from the flat plane of the garment itself, depending on the elasticity of the fabric. For sports clothes made of polyester, spandex, mesh, polyester double circular knit, and other brand names of same, etc. the flexibility and elasticity of the garment is well suited for this application.

Referring now to FIGS. 3C1-3C2, a front and side view is shown of a pocket 300-C with circular cross-section distributed spacers, according to one or more embodiments. A positive enclosure 340 secures an article inside pocket 300-C, typically with a selectively adhering closure such as a magnetic, hook-and-loop fastener, live hinge, physical snap, zipper, interference fit, buckle, etc. Pocket 300-A includes at least one access opening 346 in the present embodiment at first end 341-1, said opening for inserting and removing articles from the pocket. Top layer 302 is resistant or immune to moisture 324 and other environmental elements in the present embodiment. Spacers 310-C8 are spaced laterally with a pitch of 320 for a given horizontal row of spacers, and are spaced midway for a row with a single spacer. Spacers are also spaced vertically as previously described. Selective attachment means 328-2 at second end 341-2 utilizes a hook and loop fastener 350 in the present embodiment to allow selective detachment of second end 341-2 of pocket 300-C from garment 202, for swiveling up to allow user access. If a cell phone is disposed in pocket 300-C upside down, with the face of the phone pointing outward away from the garment 202, then swiveling up second end 341-2 of pocket 300-C will allow the user looking downward at the pocket to see the phone in its proper, right side up (and pointing outward from garment) position, ready for exchange of data. Positive enclosure flap 340 will retain the cell phone in pocket 300-C with the bottom of the cell phone against positive enclosure flap 340, and said flap will further trapped as positive enclosure 340 is wedged against garment 202 (and user), when pocket 300-C is tilted up. Note that heights of spacers 310-C8 vary across the back of pocket 300-C, depending on where the spacer is located vertically and horizontally.

Spacers 310-C8 are conformal to the shape of the user in the present embodiment, namely for a user's thigh, which has a high degree of curvature laterally, and a mild degree of curvature vertically. Thus, in general, spacers at the outer sides of pocket have a taller height, because the thigh muscle (the quadriceps) curve sharply away from the vertical median of the femur (of the pocket location), and spacers at the at the top and bottom of the pocket will be slightly taller because the thigh muscle curves slightly away from the horizontal median half-way down the thigh (for the pocket location). Hence, spacers shown with height H3 are the tallest because they and are placed on the outer left and right side of pocket 300-C and because they are located toward first end 341-1 and second end 341-2 H2. Spacers with height H2 are the second tallest, being disposed at the outer right and left side of pocket 300-C which requires more height compensation than the vertical position being in the mid-point between first end 341-1 and second end 341-2. Finally, spacer height H1 is the shortest because it is located at the horizontal median, which is the crown of the thigh's lateral curvature. Any type of conformal sizing of spacers is possible depending on the application using the principle espoused herein. The same curvature customizing is applicable for rectangular cross-section spacers, like those shown in figures starting with '3A'.

Referring now to FIG. 3C3, an isometric view is shown of an exemplary spacer made of a porous material for offsetting a pocket, according to one or more embodiments. Spacer 310-C is an open cell foam 323 type of porous material that allows communication of moisture and air therethrough. Spacer 310 can be made of any material that has: flexibility or elasticity to conform against a mating application, e.g., a user, to absorb shock, movement, flexing of muscle, etc.; and an ability to communicate or transmit moisture, so as to provide a comfortable interface with a user.

Referring now to FIGS. 3D1 and 3D2, a front view and side view, respectively, is shown of a pocket 300-C for an article or an electronic device, wherein one end of the pocket 341-1 is not selectively detachable but is hingably rotatable, and wherein the other end of the pocket 341-2 is selectively detachable, according to one or more embodiments. The selective attachment means 328-2 for the bottom end 342-2 is comprised of a mating half of zipper 328-2A disposed toward the pocket, and a mating half of zipper 328-2B, disposed towards the garment. Clear window 304 allows keypad of electronic device to appear through pocket 300-C for data exchange. Audio cord 329 for headset or earbuds is routed through access hole 327-1 formed in pocket 300-C. While face of cell phone is exposed in this embodiment with pocket is in the fastened-down state, the tradeoff is that the face is also readily accessible for viewing.

Referring now to FIGS. 3E1 and 3E2, a side view and a top-down view, respectively, is shown of a pocket 300-C for an article or an electronic device, wherein the pocket is rotated, or articulated, in situ about first, or top, end 341-1 for user access to an electronic device keypad, according to one or more embodiments. Garment side mating half of selective attachment means 328-2B, e.g., zipper half, is fully detached from pocket-side mating half of selective attachment means, 328-2A, e.g., other zipper half, thereby allowing second, or bottom, end 341-2 of pocket 303-C to swing, articulate, or rotate in a circular path 362 to an approximate shown angle of 30 degrees, with a full range of motion being 0-180 degrees, the latter which would be flush with a side of garment above first end of pocket 341-1. FIG. 3E2 is the view shown from a standing or sitting user's eye perspective of FIG. 3E1, i.e., looking down on the keypad and entering a phone number. Spacers 310-A2 are rectangular horizontal spacers similar to those shown in FIG. 3A2*b*. Spacers 310-A2 can be tall enough such that pocket in fastened-down state against garment 202, providing positive load against spacers 310-A2 to avoiding slapping and flopping of pocket against, garment 202 and user.

Referring now to FIGS. 3F1, 3F2, and 3F3, a front and side view, and an isometric view is shown of a hingably rotated pocket for storing an article or electronic device, wherein the device is loaded facing inward when pocket is coupled at both ends to the garment, according to one or more embodiments. In the present embodiment, when the pocket is in the fastened down state, the face of the phone (keypad) is facing inwardly toward the underlying garment worn by the user, e.g., either for protection of the face of the electronic device, or for privacy of the display therein. The back of the cell phone is displayed in FIG. 3F1. First end 341-1 of pocket 300-C has selectively detachable means 328-1, such as mating portions of a zipper, with one portion 328-1A of the zipper attached to the pocket 300-C and the other portion 328-1B of the zipper attached to garment 202. By detaching zipper 328-1 and swinging first end 341-1 of pocket 300-C downward on path 364, as shown in FIGS. 3F2 and 3F3 (but said figures having opposite orientations from each other), the face of the cell phone is exposed for communicating data. Spacers 310-E are oval cross-section cylinders coupled to first layer 301 in order to distance first layer 301 of pocket from garment 202 for air circulation and user comfort.

Referring now to FIGS. 3G1 and 3G2, a side view is shown of a retracted spring-loaded coil 352-A and an extended spring-loaded coil 352-B, respectively, that elastically retains second end 341-2 of the pocket 300-G1 and —G2 to garment 202 or to a strap such as that shown in FIG. 3J1, according to one or more embodiments. Spacer embodiment 310-A in FIG. 3G1 resemble those of FIG. 3A2*b*, while spacer embodiment 362 of FIG. 3G2 resemble those of FIG. 3A1, with the former spacers coupled to garment 202, and the latter coupled to pocket 300-G2. Coil 352 provides a constant tension on pocket and the article therein, to garment 202, thus providing full-time tension on article to prevent undesired movement, such as slapping and flopping of pocket against user during strenuous activity, such as a workout. Yet coil 352 also provides easy articulation at any other time, by a user simply overcoming the spring load of coil 352 via manually lifting pocket from behind, i.e. open space 314. The simply support arrangement of spacers 310-A2 in FIG. 3G1 provides ample space 314 for flexing of user's thigh while still maintaining an airflow 10 gap between garment 202 and pocket 300-G1. Pocket 300-G1 or —G2 is removable from garment 202 for cleaning or for servicing coil 352. Coil 350 is a flexible string, cable, cord, or ribbon wound around a spool having a real adequate spring, i.e. a reel spring, for maintaining tension. A single coil 350 can be disposed in the middle of a width of pocket or at each corner of pocket 350-G1, -G2, similar to location of tabs 315 in FIG. 3A1.

Referring now to FIGS. 3H1, 3H2, and 3H3, a front view, top view, and side view are shown of a pocket 300-H for housing an article or an electronic device, wherein the pocket has a selectively detachable means at both sides of the pocket, according to one or more embodiments. In this embodiment, selective attach means 328-3 and 328-4 are disposed on sides of pocket 300-H, with spacers 310-H having profile 320 and oriented vertically, parallel with direction of selective attach means 328-3 and —4. In this manner, air circulation 10 will flow between top end 341-1 to bottom end 341-2 of pocket. Different embodiments of selectively detachable or non-detachable means on either side of pocket 300-H can be used.

Referring now to FIGS. 3J1, 3J2, and 3J3, a front view, top view, and side view are shown of a pocket 300-J for housing an article or an electronic device, wherein the pocket has a loop for accepting a belt to retain the pocket to a user or object, according to one or more embodiments. Two spacers 310-J are oriented vertically and parallelly to each other similar to those shown in FIG. 3H1, wherein each has a loophole 313 for belt 354 to pass through, and each has bottom profile contour 320-H and height 314 to provide a gap for airflow 10 between pocket 300-J and garment 202. Belt 354 is used to retain pocket 300-J to arm, leg, or waist of wearer. Because top end 341-1 and bottom end 341-2 of pocket 300-J are not coupled to garment, and because belt 354 is disposed in a middle span of pocket height, and because belt 354 has elasticity, the leverage provided by user to tilt pocket 300-J up at second end 341-2 provides a reasonable, though limited, view of face of cell phone disposed in pocket.

Referring now to FIG. 3K, a side view is shown of a pocket for storing an article or an electronic device, wherein fabric encloses backside of pocket including spacers, according to one or more embodiments. Spacers 310-K and coil 352 of FIG. 3K are described in prior FIGS. 3G1 and G2. The eye is from the perspective of a user/wearer of pocket 310-K on a workout pant thigh location. A third layer of fabric 356 covers pocket from side 305 of pocket 300-K down past height of spacers 310-K, across bottom of spacers 310-K and back up the other side, and also up to first end 341-1 and second end 341-2. Thus, the entire backside of pocket 310-K is enclosed, including spacers 310-K, thereby making none of spacers 310-K visible unless third layer 356 of fabric is transparent or translucent, e.g., clear plastic. Third layer 356 of FIG. 3K can be applied to nearly any prior embodiment of pocket provided herein. On the bottom surface of third layer 356 and facing garment 202, is sleeve 322 for cards, as previously described. While third layer 356 of fabric might impede access by user, e.g., reaching under pocket to tilt it upward for viewing, and while third layer 356 of fabric might reduce air flow between pocket 300-K and garment 202, third layer 356 nonetheless provides a benefit of avoiding contaminants from gathering between spacers 310-K and under second layer 302 of pocket 300-K. Third layer 356 can be tautly drawn, or loosely hung, around pocket 300-K to enclose spacers 310-K.

Referring now to FIG. 3L, a side view is shown of a pocket 300-L for storing an article or an electronic device, wherein the spacers vary in height across the length of the pocket, according to one or more embodiments. The different spacers 310-C1, -C2, -C3 have different heights are disposed along a length of the pocket from a first attach point 341-1 to a second attach point 328-2B. In this manner, if the surface against which the spacers 310-C1, -C2, -C3 rest is flat, such as a user's substantially level thigh, then a face of the pocket, aka second layer 302 of FIG. 3A2*a*, is disposed at an angle from the underlying surface (the user) and at an angle to viewer. This improves the viewability of the device, in an attached position to a garment because the face is not vertical (for a standing user having pocket attached to a thigh) but rather on a slant, thus providing an angled view of the face for the user. This slanted view is for the pocket in an attached position at both ends of the pocket—and is a static slanted position without any input or holding by the user, as a hands-off, slanted embodiment. If the user has a slanted surface, e.g., a taper off of the thigh towards the knee, then the different spacers 310-C1, -C2, -C3 are sized in one embodiment to at least compensate for that taper off, thus leaving the device essentially in an up-down, vertical orientation. Besides having different heights, different spacers 310-C1, -C2, -C3 also have a lateral shaping, similar to that shown in FIGS. 3A3*b*-3A3*f*. Any quantity of different spacers 310-C1, -C2, -C3 can be used, from two to five or more. In one embodiment, only two spacers are used, one at the top and one at the bottom end of the pocket, i.e., minus spacer 310-C2. In this embodiment, a space under pocket 300-L, where spacer 310-C2 would otherwise be, now allows for flexing and contraction of a pocket wearer's muscle, which would otherwise interfere with spacer 310-C2.

Referring now to FIGS. 4A1, 4A2, 4B1, 4B2, 4C, 4D1, 4D2, 4D3, 4D4, and 4E1 front views are shown of different garment applications for a pocket in which to store an article or an electronic device, wherein the pocket has spacers for breathability and the pocket has different configurations of retention to the garment or a strap, according to one or more embodiments. FIGS. 4A1 and A2 are a workout pant 400-A of spandex material that illustrate a pocket for storing electronic device, with pocket having spacers and shown in a fastened down state 402-A1 and in a flipped-up state 402-A2, respectively, made possible by selectively attachable means at second end of pocket. These embodiments are similar to those shown in FIGS. 3D1, 3E1, and 3E2, with a non-releasable top end and a selectively releasable bottom end. In contrast, FIGS. 4B1 and 4B2 show a workout pant 400-B utilizing pocket 402-B1 having the belt and loophole retention embodiment, as described in FIGS. 3J1-3J3, which still allows for a moderate tilt up as shown flipped up state 402-B2. The advantage of pocket 402-B1 is that the pocket and the strap is fully removable and can be re-applied to any garment (or just to a bare leg), without needing an attachment to the garment. Turning now to FIG. 4C, a pair of workout shorts 400-C is shown with a fully releasable pocket 402-C. Note that garment side mating half of selectively releasable attachment means, is described in FIGS. 2B, 3A1, and 3A2*a*.

Turning now to FIGS. 4D1-4D4, a workout shirt of nylon or spandex material 400-D is shown with different pocket retention embodiments. Starting with pocket configurations 402-D1 and D2 in FIGS. 4D1 and D2, a fastened down state and flipped up state, respectively, is shown for the pocket, with a retention embodiment similar to that described in FIGS. 4A1 and 4A2. In FIG. 4D3, pocket 402-D3 is retained by the belt and loophole spacers embodiment, similar to that shown for FIG. 4B1. In FIG. 4D4, pocket 402-D4 implements a selectable retention means disposed on a side of the pocket, similar to that describe in FIG. 3H1-3H3. Finally, in FIG. 4E1, pocket 402-E is retained via a cord or strap 406 coupled to pocket 402-E tabs 315 described in FIGS. 3A1-3A2, with cord 406 disposed around a torso of a user. FIG. 4E2 illustrates an enlarged view of cord 406 with opening 408 in hollow strap/cord 406 allowing power cord or audio wire(s) 329 to be retained therein. Hole 408 is large enough to feed an adapter plug, e.g., 2.5-3.5 mm jack, or a power cord for legacy wired systems.

Alternatives

Of course, the above advantages are exemplary, and these or other advantages may be achieved by the invention. Further, the skilled person will appreciate that not all advantages stated above are necessarily achieved by embodiments described herein.

In the foregoing specification, the invention has been described with reference to specific examples of embodiments of the invention. It will be evident however, that various modifications and changes may be made therein without departing from the broader spirit and scope of the invention as set forth in the appended claims.

Any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected," or "operably coupled," to each other to achieve the desired functionality. However, other modifications, variations and alternatives are also possible. The specifications and drawings are, accordingly, to be regarded in an illustrative rather than in a restrictive sense.

In the claims, any reference signs placed between parentheses shall not be construed as limiting the claim. The word 'comprising' does not exclude the presence of other elements or steps then those listed in a claim. Furthermore, the terms "a" or "an," as used herein, are defined as one as or more than one. Also, the use of introductory phrases such as "at least one" and "one or more" in the claims should not be construed to imply that the introduction of another claim element by the indefinite articles "a" or "an" limits any particular claim containing such introduced claim element to inventions containing only one such element, even when the same claim includes the introductory phrases "one or more"

or "at least one" and indefinite articles such as "a" or "an." The same holds true for the use of definite articles. Unless stated otherwise, terms such as "first" and "second" are arbitrarily used to distinguish between the elements such terms describe. Thus, these terms are not necessarily intended to indicate temporal or other prioritization of such elements. The mere fact that certain measures are recited in mutually different claims does not indicate that a combination of these measures cannot be used to advantage.

As used throughout this application, the word "may" is used in a permissive sense (i.e., meaning having the potential to), rather than the mandatory sense (i.e., meaning must). Similarly, the words "include," "including," and "includes" mean including, but not limited to in that context.

Methods and operations described herein can be in different sequences than the exemplary ones described herein, e.g., in a different order. Thus, one or more additional new operations may be inserted within the existing operations or one or more operations may be abbreviated or eliminated, according to a given application. Other features of the present embodiments will be apparent from the accompanying drawings and from the detailed description.

The foregoing descriptions of specific embodiments of the present disclosure have been presented for purposes of illustration and description. They are not intended to be exhaustive or to limit the invention to the precise forms disclosed. Many modifications and variations are possible in light of the above teaching without departing from the broader spirit and scope of the various embodiments. The embodiments were chosen and described in order to explain the principles of the invention and its practical application best and thereby to enable others skilled in the art to best utilize the invention and various embodiments with various modifications as are suited to the particular use contemplated. It should be appreciated that embodiments, as described herein, can be utilized or implemented alone or in combination with one another. While the present invention has been described in particular embodiments, it should be appreciated that the present invention should not be construed as limited by such embodiments, but rather construed according to the claims appended hereto and their equivalents. The present invention is defined by the features of the appended claims.

What is claimed is:

1. An apparatus comprising:

a first selective garment attachment interface disposed at a first end of a pocket; and a second selective garment attachment interface disposed at a second end of the pocket distal from the first end, the first and second selective garment attachment interfaces configured to selectively couple to corresponding mating parts on a surface of a garment, wherein a plurality of spacers disposed between the first selective garment attachment interface and the second selective garment attachment interface offset the pocket a given distance away from the garment.

2. The apparatus of claim 1, further comprising a loophole disposed on the pocket on a side of the pocket between the first and second ends.

3. The apparatus of claim 2, wherein the loophole is sized to selectively receive a belt, the belt configured to couple the pocket to one or more of an arm and a leg of a user.

4. The apparatus of claim 1, further comprising one or more tabs disposed on the pocket, the one or more tabs configured to selectively couple the pocket to a strap disposable around a torso of a user.

5. The apparatus of claim 4, wherein the strap is hollow and configured to selectively receive one or more of a power cord and an audio wire within the strap.

6. The apparatus of claim 1, further comprising:

a first layer providing an interior layer of the pocket to face against the garment;

a second layer providing an exterior layer of the pocket; and a plurality of spacers coupled to the first layer of the pocket; and wherein:

the plurality of spacers offset the pocket a given distance away from the garment.

7. The apparatus of claim 6, wherein the plurality of spacers are disposed in a given plane.

8. The apparatus of claim 6, wherein at least one of the plurality of spacers has a different shape than at least another one of the plurality of spacers.

9. The apparatus of claim 6, wherein at least two sides of the pocket have no attachments for coupling the pocket to the garment.

10. The apparatus of claim 6, wherein:

the second layer has a window for viewing the article disposed inside the pocket; and the first layer is comprised of a breathable material.

11. The apparatus of claim 6, wherein the second layer that is the exterior layer comprises a moisture resistant material.

12. The apparatus of claim 6, further comprising a sleeve disposed between the first layer of the pocket and the second layer of the pocket for holding at least one card.

13. The apparatus of claim 1, wherein the first and second selective garment attachment interfaces each comprise a portion of a zipper configured to interface with corresponding portions of the zipper disposed on the garment.

14. An apparatus comprising:

first means for selectively coupling a pocket to a surface of a garment worn by a user, wherein the first means is configured to automatically reattach the pocket to the surface of the garment when released from a tilted-up position;

second means for selectively coupling the pocket to a belt worn by the user, the belt configured to couple the pocket to one or more of an arm and a leg of the user; and third means for selectively coupling the pocket to a strap, wherein the strap is disposable around a torso of the user.

15. The apparatus of claim 14, wherein the strap is hollow and configured to selectively receive one or more of a power cord and an audio wire within the strap.

16. The apparatus of claim 14, further comprising:

a first layer providing an interior layer of the pocket to face against the garment;

a second layer providing an exterior layer of the pocket; and means for offsetting the pocket a given distance away from the garment.

17. The apparatus of claim 16, wherein the means for offsetting the pocket a given distance away from the garment comprises a plurality of spacers disposed in a given plane.

18. The apparatus of claim 17, wherein at least one of the plurality of spacers has a different shape than at least another one of the plurality of spacers.

19. The apparatus of claim 18, wherein at least two sides of the pocket have no attachments for coupling the pocket to the garment.

* * * * *